US009222050B1

(12) United States Patent
Simonetti et al.

(10) Patent No.: US 9,222,050 B1
(45) Date of Patent: Dec. 29, 2015

(54) LUBRICANT COMPOSITION, METHOD OF PREPARING THE SAME, AND FIREARM CLEANER INCLUDING THE SAME

(71) Applicant: RAND Innovations LLC, Westport, CT (US)

(72) Inventors: Mark Simonetti, Westport, CT (US); James A. Randel, Westport, CT (US)

(73) Assignee: RAND INNOVATIONS, LLC, Westport, CT (US)

( * ) Notice: Subject to any disclaimer, the term of this patent is extended or adjusted under 35 U.S.C. 154(b) by 86 days.

(21) Appl. No.: 13/778,586

(22) Filed: Feb. 27, 2013

Related U.S. Application Data

(60) Provisional application No. 61/604,622, filed on Feb. 29, 2012, provisional application No. 61/723,543, filed on Nov. 7, 2012.

(51) Int. Cl.

| | |
|---|---|
| ***C10M 125/22*** | (2006.01) |
| ***C10M 125/26*** | (2006.01) |
| ***C10M 141/10*** | (2006.01) |
| ***C10M 141/08*** | (2006.01) |
| ***F41A 29/04*** | (2006.01) |
| ***C10M 125/02*** | (2006.01) |
| ***C10M 133/30*** | (2006.01) |

(52) U.S. Cl.
CPC ..... *C10M 125/26* (2013.01); *C10M 125/02* (2013.01); *C10M 125/22* (2013.01); *C10M 133/30* (2013.01); *C10M 141/08* (2013.01); *C10M 141/10* (2013.01); *F41A 29/04* (2013.01)

(58) Field of Classification Search
None
See application file for complete search history.

(56) References Cited

U.S. PATENT DOCUMENTS

| | | | | |
|---|---|---|---|---|
| 3,518,917 | A * | 7/1970 | Sluhan | 409/131 |
| 3,645,901 | A | 2/1972 | Matson | |
| 3,915,870 | A * | 10/1975 | Brown | 508/125 |
| 3,968,302 | A * | 7/1976 | Brown | 428/328 |
| 4,584,115 | A | 4/1986 | Davis | |
| 4,758,362 | A | 7/1988 | Butke | |
| 4,889,647 | A | 12/1989 | Rowan et al. | |
| 4,997,969 | A | 3/1991 | Luciani | |
| 5,137,647 | A | 8/1992 | Karol | |
| 5,399,274 | A * | 3/1995 | Marcus | 508/195 |
| 5,412,130 | A | 5/1995 | Karol | |
| 7,195,828 | B2 | 3/2007 | Gunsel et al. | |
| 7,205,423 | B1 | 4/2007 | Gershon et al. | |
| 7,749,947 | B2 | 7/2010 | Griffo et al. | |
| 7,763,744 | B2 | 7/2010 | Tynik et al. | |
| 2002/0086168 | A1 * | 7/2002 | Sadvary et al. | 428/447 |

(Continued)

FOREIGN PATENT DOCUMENTS

| | | |
|---|---|---|
| EP | 2195404 B1 | 7/2012 |
| GB | 2437821 A | 11/2007 |

(Continued)

OTHER PUBLICATIONS

Rapoport, L., et al., "Hollow nanoparticles of WS2 as potential solid-state lubricants", Nature, Jun. 19, 1997, vol. 387, pp. 791-793.

(Continued)

*Primary Examiner* — Joseph D Anthony
(74) *Attorney, Agent, or Firm* — Cantor Colburn LLP

(57) ABSTRACT

A lubricant composition including: tungsten disulfide having a particle size of 4 to 160 nm; an alkali metal borate; a borate ester; and a base oil.

21 Claims, 7 Drawing Sheets

(56) References Cited

U.S. PATENT DOCUMENTS

| | | | | |
|---|---|---|---|---|
| 2004/0138073 | A1* | 7/2004 | Karol et al. | 508/195 |
| 2005/0124504 | A1 | 6/2005 | Zhang et al. | |
| 2008/0234154 | A1 | 9/2008 | Boudreau | |
| 2009/0048129 | A1 | 2/2009 | Mabuchi et al. | |
| 2009/0155479 | A1 | 6/2009 | Xiao et al. | |
| 2010/0040864 | A1 | 2/2010 | McGilvray et al. | |
| 2010/0048436 | A1* | 2/2010 | Litters et al. | 508/174 |
| 2010/0113312 | A1 | 5/2010 | Ward et al. | |
| 2010/0187925 | A1 | 7/2010 | Tingler et al. | |
| 2010/0199943 | A1 | 8/2010 | Carrick | |
| 2012/0214717 | A1 | 8/2012 | McLaughlin et al. | |
| 2012/0302472 | A1* | 11/2012 | Litters et al. | 508/122 |
| 2012/0304545 | A1 | 12/2012 | Park et al. | |
| 2014/0371119 | A1 | 12/2014 | Mosleh | |

FOREIGN PATENT DOCUMENTS

| | | | |
|---|---|---|---|
| GB | 2454103 | A | 4/2009 |
| WO | 2007082288 | A2 | 7/2007 |
| WO | 2007082299 | A2 | 7/2007 |
| WO | 2010085802 | A1 | 7/2010 |
| WO | 2011011714 | A1 | 1/2011 |
| WO | 2011099823 | A2 | 8/2011 |

OTHER PUBLICATIONS

Wiesel, Inna et al.: "Synthesis of WS2 and MoS2 Fullerene-Like Nanoparticles from Solid Precursors", Nano Res (2009), vol. 2, pp. 416-424.

* cited by examiner

LUBRICANT COMPOSITION, METHOD OF PREPARING THE SAME, AND FIREARM CLEANER INCLUDING THE SAME

CROSS REFERENCE TO RELATED APPLICATION

This application claims priority to U.S. Provisional Application Ser. No. 61/604,622, filed on Feb. 29, 2012, and U.S. Provisional Application Ser. No. 61/723,543, filed on Nov. 7, 2012, the contents of which in their entirety are herein incorporated by reference.

BACKGROUND OF THE INVENTION

1) Field of the Invention

Disclosed is a lubricant composition, a method of preparing the same, and a firearm cleaner including the lubricant composition.

2) Description of the Related Art

Lubricants also can provide a variety of functions including friction reduction, heat removal, containment of contaminants, and corrosion protection, for example.

Firearms should be cleaned at regular intervals to remove the remnants of combustion and bullets, to remove debris, and to provide a protective coating to prevent corrosion. The cleaning typically includes rubbing the components of the firearm with a lubricant to remove residue, such as soot, and particulates, which can accumulate in a gun barrel and other components, such as the trigger, breech, and ejection port, for example. Failure to clean a firearm can result in reduced function, e.g., jamming, reduced accuracy, and safety issues.

Various methods and agents for the cleaning of a gun barrel are known, however there remains a need for an improved lubricant for firearm maintenance. Also, for other applications, such as lubrication of industrial machinery or engines, reducing friction and wear can be especially desirable. Thus there remains a need for an improved lubricant which provides improved performance, such as extended life, reduced maintenance costs, and improved reliability.

SUMMARY

Disclosed is a lubricant composition including: tungsten disulfide having a particle size of 4 to 160 nanometers; an alkali metal borate; a borate ester; and a base oil.

Disclosed is an applicator having the lubricant composition disposed on the applicator.

Disclosed is a firearm cleaning system including: a container; an applicator disposed in the container; and a lubricant composition disposed on the applicator, wherein the lubricant composition includes tungsten disulfide having a particle size of 4 to 160 nanometers; an alkali metal borate; a borate ester; and a base oil.

Disclosed is a lubricant composition including: tungsten disulfide having a particle size of 4 to 80 nm; diamond having a particle size of 2 to 50 nm; boron oxide having a particle size of 20 to 200 nm; an organic tungsten composition; and a base oil.

Disclosed is a method of manufacturing a lubricant composition, the method including: contacting tungsten disulfide having a particle size of 4 to 160 nanometers, an alkali metal borate, a borate ester, and a base oil under conditions effective to disperse the tungsten disulfide, the alkali metal borate, and the borate ester in the base oil to manufacture the lubricant composition.

Also disclosed is a method of manufacturing a lubricant composition, the method including: contacting tungsten disulfide having a particle size of 4 to 80 nm, diamond having a particle size of 2 to 50 nm, boron oxide having a particle size of 20 to 200 nm, an organic tungsten composition, and a base oil under conditions effective to disperse the tungsten disulfide, the diamond, and the boron oxide, and the organic tungsten composition in the base oil to manufacture the lubricant composition.

These and other features, aspects, and advantages of the disclosed embodiments will become better understood with reference to the following description and appended claims.

BRIEF DESCRIPTION OF FIGURES

The disclosed subject matter is particularly pointed out and distinctly claimed in the claims at the conclusion of the specification. The foregoing and other aspects, features, and advantages of the disclosed embodiments are apparent from the following detailed description taken in conjunction with the accompanying drawings in which:

Figure 1:
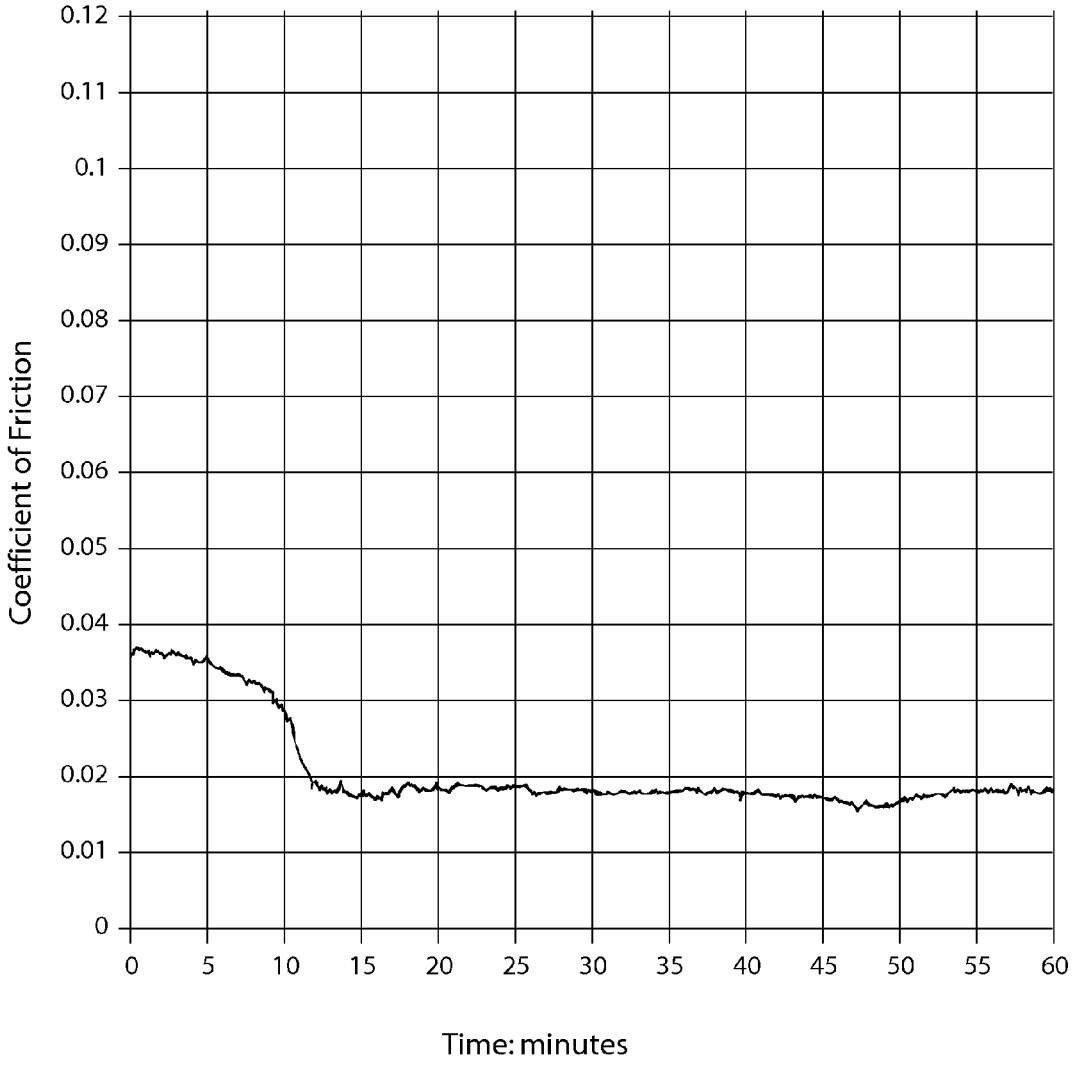
FIG. 1 is a graph of coefficient of friction versus time and shows the results of Example 4.
Figure 2:
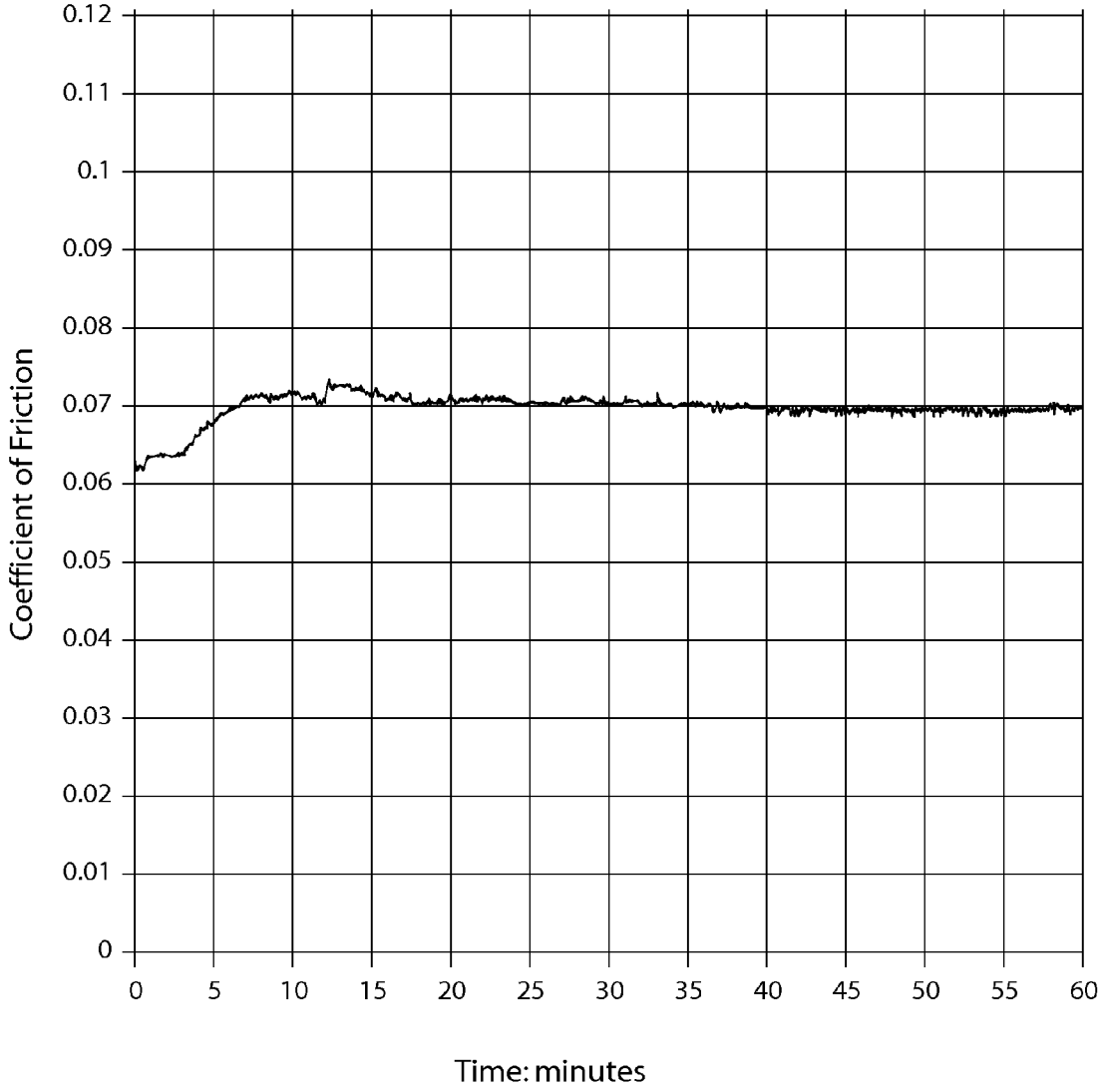
FIG. 2 is a graph of coefficient of friction versus time and shows the results of Example 5.
Figure 3:
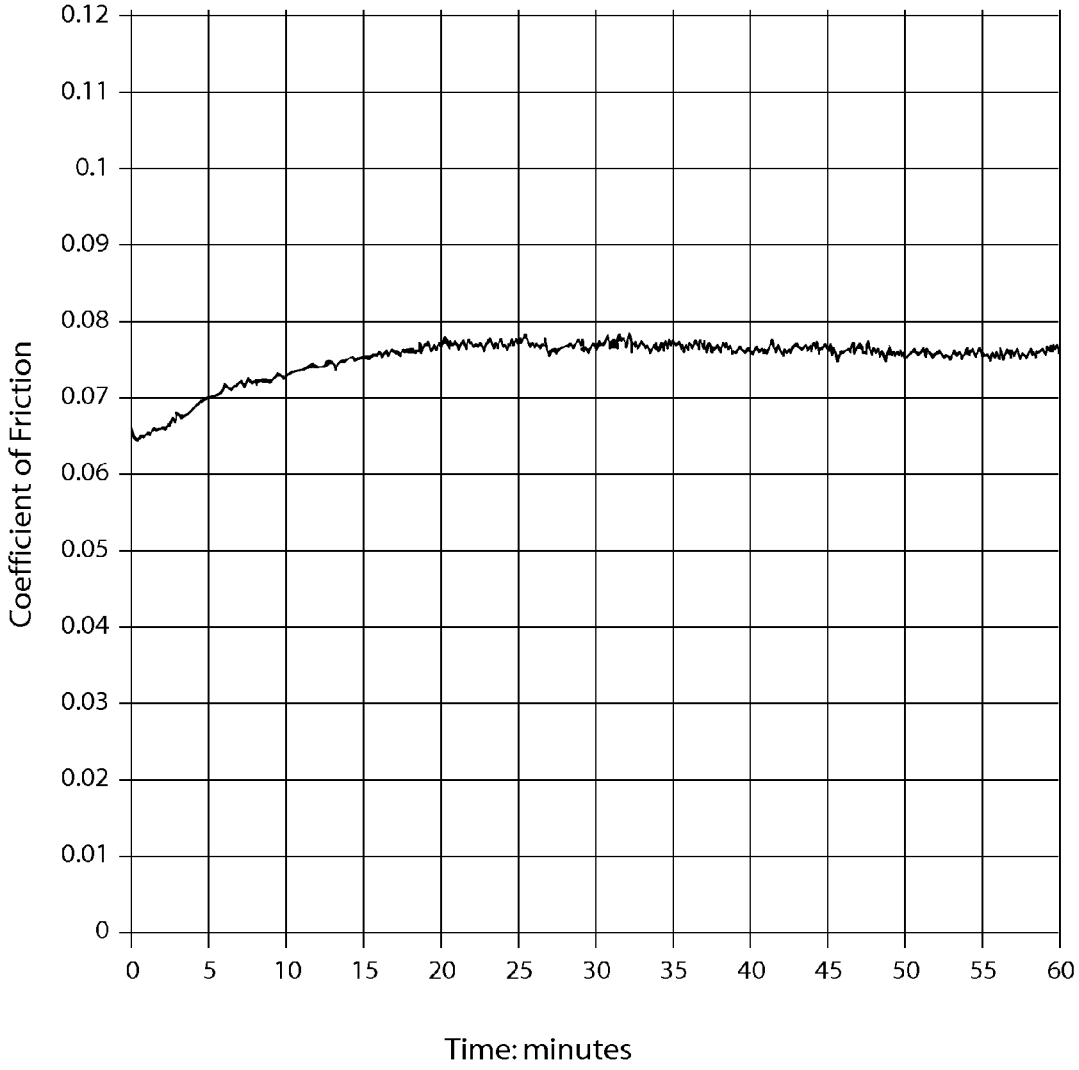
FIG. 3 is a graph of coefficient of friction versus time and shows the results of Example 6.
Figure 4:
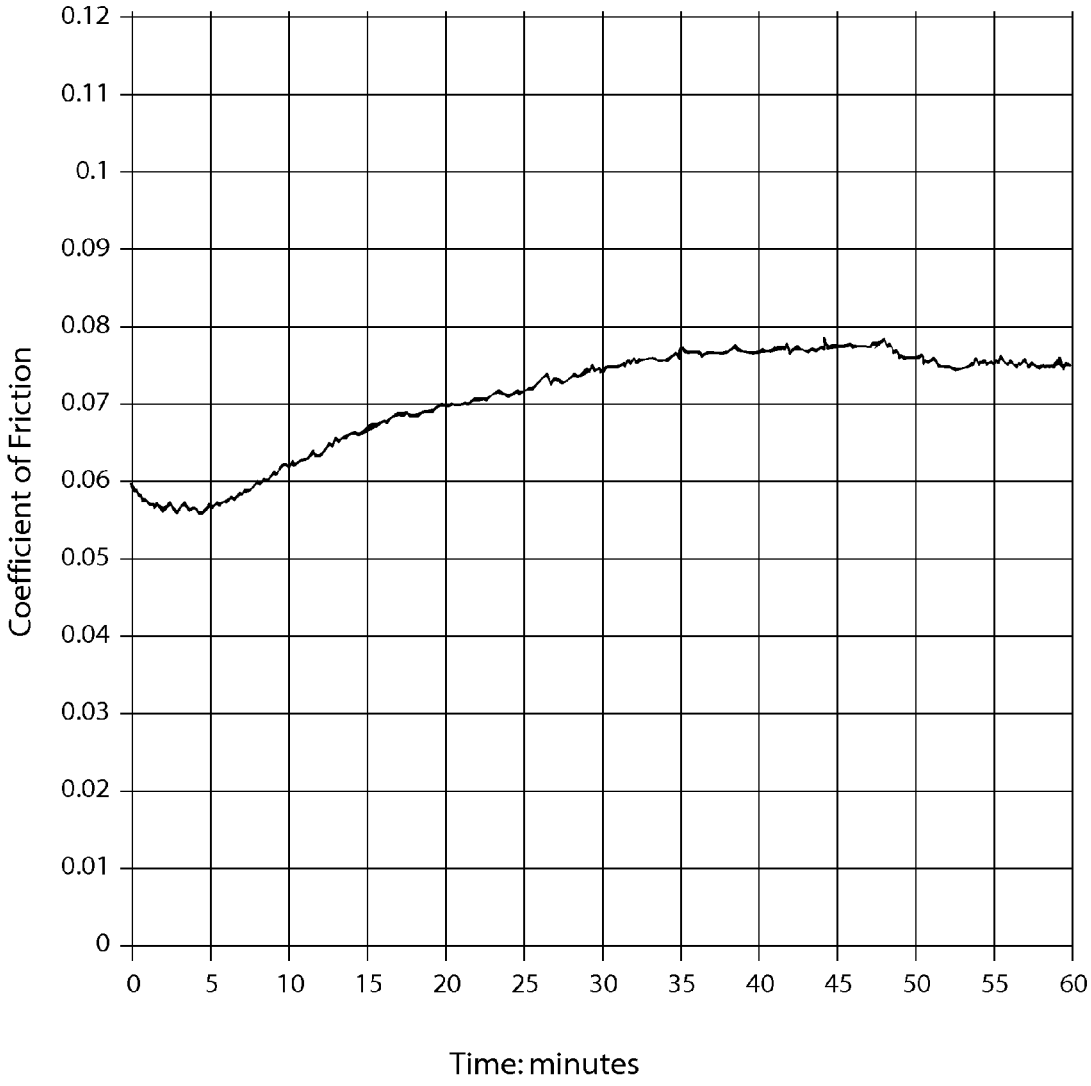
FIG. 4 is a graph of coefficient of friction versus time and shows the results of Example 7.
Figure 5:
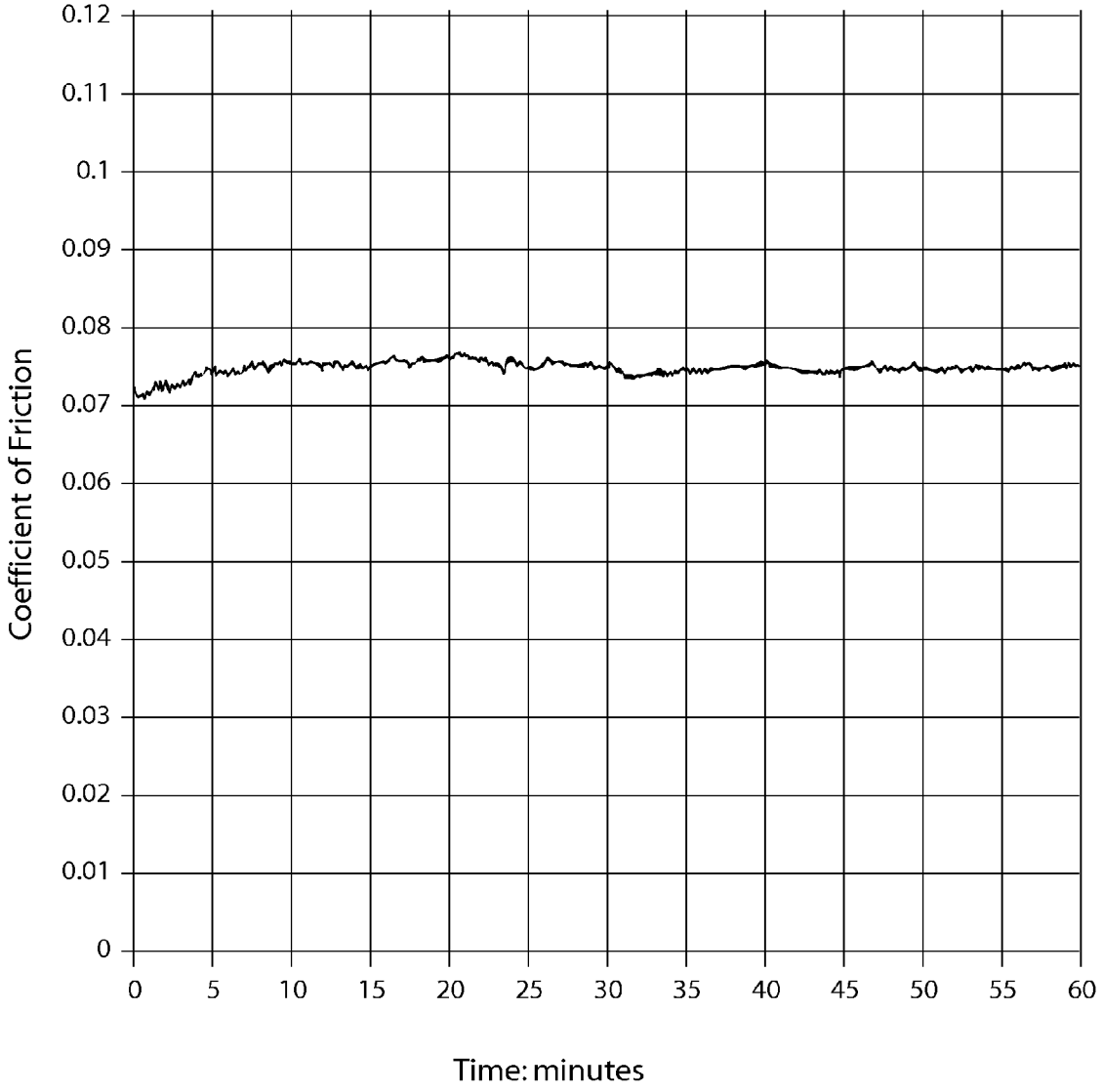
FIG. 5 is a graph of coefficient of friction versus time and shows the results of Example 8.

The detailed description explains the exemplary embodiments, together with advantages and features, by way of example with reference to the drawings.

DETAILED DESCRIPTION

Disclosed is a lubricant composition comprising: tungsten disulfide having a particle size of 4 to 160 nanometers; an alkali metal borate; a borate ester; and a base oil.

Also disclosed is a lubricant composition comprising: tungsten disulfide having a particle size of 4 to 80 nm; diamond having a particle size of 2 to 50 nm; boron oxide having a particle size of 20 to 200 nm; an organic tungsten composition; and a base oil.

The lubricant composition may be used as is or added to an additional quantity of a base oil. The lubricant composition may be used for the cleaning and maintenance of a gun, in an engine, such as a gasoline or diesel engine, as a motor oil, or as a restorative agent, for example. In another embodiment the lubricant composition may be used as a polishing agent. It has been surprisingly discovered that when used as a lubricant for a firearm, desirable performance and reliability are provided.

The lubricant composition comprises tungsten disulfide. While not wanting to be bound by theory, it is understood that the tungsten disulfide of the lubricant composition may have a layered crystal structure comprising layers of tungsten atoms in a hexagonal arrangement interposed between sulfur layers. The bonding between the layers is understood to be primarily a Van der Waals type interaction and weak as compared to the bond strength within the W or S layers. When a force is applied in the direction of the layers, the weak bonding between the layers allows the layers to shear easily, providing a laminar lubricating mechanism that can provide superior lubricity.

The tungsten disulfide may have any suitable shape, and may be in the form of a sphere, plate, rod, disk, tube, or a combination thereof. Also, the tungsten disulfide may have various cross-sectional shapes, such as a rectilinear or a curvilinear shape, such as a rectangular, triangular, polygonal, oval, elliptical, or circular cross-sectional shape, or a combination thereof. In an embodiment the tungsten disulfide has a structure comprised of closed polyhedra to provide a fullerene-like structure, e.g., a buckeye-ball like structure, or a nanotube structure. In an embodiment the tungsten disulfide may have a multiply layered structure in which each layer comprises closed polyhedral to provide a fullerene-like, onion-like, or multiwall nanotube structure. Inorganic-fullerene tungsten disulfide is specifically mentioned. While not wanting to be bound by theory, it is understood that inorganic-fullerene tungsten disulfide comprises multiwall spheres of tungsten disulfide. The preparation of inorganic-fullerene tungsten disulfide has been described in Inna Wiesel, Hamutal Arbel, Ana Albu-Yaron, Ronit Popovitz-Biro, Jeffrey M. Gordon, Daniel Feuermann, and Reshef Tenne, Synthesis of $WS_2$ and $MoS_2$ Fullerene-Like Nanoparticles from Solid Precursors, Nano Res (2009) 2: 416 424, the contents of which in its entirety is herein incorporated by reference. While not wanting to be bound by theory, it is understood that the spherical shape of the inorganic-fullerene tungsten disulfide further promotes reduction of friction in concert with the layered crystal structure of tungsten disulfide.

The tungsten disulfide can further comprise a passivating layer. The passivating layer may comprise, for example, a tungsten oxide (e.g., $WO_3$) on the surface of the $WS_2$ particles. The tungsten oxide passivating layer can inhibit oxidation, and can also have desirable friction properties. In addition it is understood that the tungsten disulfide can adhere to metal surfaces, and can aid in the burnishing of wearing surfaces, thereby providing additional friction reduction, reduced wear, and corrosion protection. Furthermore, because of the burnishing properties provided by the tungsten disulfide, the tungsten disulfide can aid in the restoration and/or polishing of components. Thus, while not wanting to be bound by theory, it is understood that the tungsten disulfide provides a variety of desirable cleaning, lubricating, and protecting properties.

A direction of the tungsten disulfide may be aligned with a direction of moving surfaces, further reducing friction. For example, in an embodiment in which the tungsten disulfide has a rectilinear shape, e.g., is in the form of platelet, the tungsten disulfide may be aligned such that the major surface of the tungsten disulfide is parallel to the direction of the moving surfaces. Also, the tungsten and sulfur layers of the tungsten disulfide may be parallel to the major surface of the tungsten disulfide particle (e.g., a major surface of a platelet), and thus the tungsten and sulfur layers may be parallel to the direction of the moving surfaces.

The tungsten disulfide having a particle size (e.g., a largest particle diameter) of 4 to 160 nanometers (nm), specifically 6 to 140 nm, more specifically 8 to 120 nm, or 10 to 80 nm. Use of a tungsten disulfide having a particle size of 8 to 20 nm is specifically mentioned. The tungsten disulfide may have an average particle size (e.g., an average largest particle diameter) of 10 to 1000 nm, specifically 20 to 800 nm, more specifically 40 to 600 nm, or 60 to 500 nm. Also, the tungsten disulfide may be contained in the lubricant composition in an amount of 0.001 to 3 weight percent (wt %), specifically 0.01 to 2 wt %, more specifically 0.05 to 1 wt %, based on the total weight of the lubricant composition. Alternatively, the tungsten disulfide may be present in the lubricant composition in an amount of 0.001 to 1 volume percent (vol %), specifically 0.01 to 0.5 vol %, more specifically 0.05 to 0.1 vol %, based on the total volume of the lubricant composition. The particles of the tungsten disulfide may have a variety of shapes, and may be in the form of plates, rods, disks, spheres, or a combination thereof. Also, the tungsten disulfide may have various cross-sectional shapes, such as a rectangular, polygonal, oval, elliptical, or circular cross-sectional shape, or a combination thereof. The particles of the tungsten disulfide may be aligned in the direction of moving surfaces, further reducing friction. In an embodiment, the particles of tungsten disulfide may be aligned such that the planes containing tungsten atoms are parallel to the direction of the moving surfaces.

The lubricant composition may also comprise an alkali metal borate. The alkali metal borate may comprise Li, Na, K, Rb, or a combination thereof. The alkali metal borate may be a sodium borate, a potassium borate, or a combination thereof. Potassium borate is specifically mentioned. The potassium borate may be potassium metaborate, potassium pentaborate, potassium tetraborate, potassium triborate, or a combination thereof. The potassium borate may be $KBO_2$, $KB_5O_8.4H_2O$, $KBO_2.½H_2O$, $K_2B_4O_7.4H_2O$, $K_2B_4O_7.8H_2O$, $KB_3O_5.3H_2O$, or a combination thereof.

An atomic ratio of an alkali metal to boron of the alkali metal borate may be of 3:2 to 1:5, specifically 1:1 to 2:9, more specifically 1:2 to 1:4. In an embodiment, an atomic ratio of potassium to boron of the alkali metal borate is 1:1 to 1:5.

The alkali metal borate may be a hydrate or may be anhydrous. The alkali metal borate may comprise 0 to 10 moles of water, specifically 0.1 to 9 moles of water, more specifically 0.2 to 8 moles of water, per mole of the alkali metal borate. In an embodiment the alkali metal borate is anhydrous.

The alkali metal borate may have a particle size (e.g., a largest particle diameter) of 1 to 200 nm, specifically 2 to 150 nm, more specifically 4 to 100 nm, or 6 to 50 nm. An alkali metal borate having a diameter of less than 50 nm is specifically mentioned. The alkali metal borate may have an average particle size (e.g., an average largest particle diameter) of 5 to 150 nm, specifically 10 to 100 nm, more specifically 15 to 50 nm.

The alkali metal borate may have any suitable shape, and may be in the form of a sphere, plate, rod, disk, tube, or a combination thereof. Also, the alkali metal borate may have various cross-sectional shapes, such as a rectilinear or a curvilinear shape, such as a rectangular, triangular, polygonal, oval, elliptical, or circular cross-sectional shape, or a combination thereof.

The alkali metal borate may be contained in the lubricant composition in an amount of 0.01 to 10 weight percent (wt %), specifically 0.05 to 5 wt %, more specifically 0.1 to 2 wt %, based on a total weight of the lubricant composition. In another embodiment, the alkali metal borate may be contained in the lubricant composition in an amount of 0.0001 to 0.10 weight percent (wt %), specifically 0.0005 to 0.05 wt %, more specifically 0.001 to 0.02 wt %, based on a total weight of the lubricant composition. The alkali metal borate may be provided in the form of a suspension or a dispersion of the alkali metal borate in a base oil. A dispersion of potassium borate in polyalphaolefin is specifically mentioned.

The lubricant composition may also comprise a borate ester. While not wanting to be bound by theory, it is understood that the borate ester bonds to metal surfaces to provide a lubricious surface, reducing friction between adjacent moving surfaces. The borate ester compound may act as an inhibitor for corrosion of metal to prevent corrosion of either ferrous or non-ferrous metals (e.g. copper, bronze, brass, titanium, or aluminum) or both, when present in concentrations effective to inhibit corrosion. Furthermore, the borate ester may act as a dispersant and can provide desirable anti-wear and antioxidant properties.

The borate ester may be a reaction product of a boron compound and an epoxy compound, a halohydrin compound, an epihalohydrin compound, a polyol, or a combination thereof. The polyol may be a monol, diol, triol, or a higher polyol. Boron compounds suitable for preparing the borate ester include boric acid, including metaboric acid, $HBO_2$, orthoboric acid, $H_3BO_3$, and tetraboric acid, $H_2B_4O_7$, boric oxide, boron trioxide, or an alkyl borate. The borate ester may also be prepared from a boron halide. The borate ester may contain at least one hydrocarbyl group, specifically a C4 to C30 hydrocarbyl group.

Borated epoxides are described in detail in U.S. Pat. No. 4,584,115, the content of which is incorporated herein by reference in its entirety. The borated epoxide may be prepared by reacting an epoxide with boric acid or boron trioxide. Borated epoxides are not actually epoxides, but are the boron-containing reaction products of epoxides and may be a borate ester. The epoxides can be commercial mixtures of C14-16 or C14-18 epoxides, which can be purchased from ELF-ATOCHEM or Union Carbide and which can be prepared from the corresponding olefins by known methods. Purified epoxy compounds such as 1,2-epoxyhexadecane can be purchased from Aldrich Chemical. The borated compounds may be prepared by blending the boron compound and the epoxide and heating them at a suitable temperature, e.g., 80 to 250° C., optionally in the presence of an inert liquid medium, until the desired reaction has occurred. A suitable borated epoxide is the borated epoxide of a C16 olefin.

Representative borate esters include trimethyl borate, triethyl borate, tri-n-propyl borate, tri-n-butyl borate, triphenyl borate, triisopropyl borate, tri-t-amyl borate, triphenyl borate, trimethoxy boroxine, tri-2-cyclohexylcyclohexyl borate, a trialkanolamine borate such as triethanolamine borate or triisopropanolamine borate, manittol borate, and glycerol borate.

Additionally, other amino-containing borates and tertiary amine salts of boric acid may be useful. Such boron-containing compounds include, but are not limited to, 2-(beta-dimethylaminoisopropoxy)-4,5-dimethyl-1,3,2-dioxaborolane, 2-(beta-diethylaminoethoxy)4,4,6-trimethyl-1,3,2-dioxaborinane, 2-(beta-dimethylaminoethoxy)-4,4,6-trimethyl-1,3,2-dioxaborinane, 2-(betha-diisopropylaminoethoxy-1,3,2-dioxaborinane, 2-(beta-dibutylaminoethoxy)-4-methyl-1,3,2-dioxaborinane, 2-(gamma-dimethylaminopropoxy)-1,3,6,9-tetrapxa-2-boracycloundecane, and 2-(beta-dimethylaminoethoxy)-4,4-(4-hydorxybutyl)-1,3,2-dioxaborolane.

The borate ester may be a reaction product of a fatty oil and a C2 to C10 dialkanolamine, and subsequent reaction with a boric acid or other suitable reagent effective to form a borate ester. The fatty oil may be a glyceryl ester of a C6 to C30 fatty acid, specifically a glyceryl ester of a C12 to C22 fatty acid. In an embodiment, the C2 to C10 dialkanolamine is diethanolamine. The borated ester may be a reaction product of 1 mole of the fatty oil and 1 to 2.5 moles of diethanolamine followed by reaction with boric acid as provided in U.S. Patent Publication No. 2004/0138073, the content of which in its entirety is herein incorporated by reference.

The borate ester may comprise a compound of Formula 1:

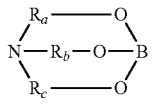

(1)

wherein in Formula 1, Ra, Rb, and Rc are each independently a substituted or unsubstituted C1 to C20 alkylene group, a substituted or unsubstituted C6 to C26 cycloalkylene group, a substituted or unsubstituted C6 to C26 arylene group, a substituted or unsubstituted C6 to C26 alkylarylene group, or a substituted or unsubstituted C6 to C26 arylalkylene group. Representative borate esters include trimethanolamine borate, triethanolamine borate, and tri-n-propanolamine borate, triisopropanolamine borate. In an embodiment, Ra, Rb, and Rc are each a C1 to C20 alkylene group. An embodiment in which Ra, Rb, and Rc are each isopropyl (to provide triisopropanolamine borate) is specifically mentioned.

The content of boron in the borate ester may be 0.1 to 3 wt %, specifically 0.5 to 2 wt %, based on a total weight of the borate ester. The borate ester may be contained in the lubricant composition in an amount of 0.01 to 20 weight percent, specifically 0.1 to 15 weight percent, more specifically 1 to 10 weight percent, based on a total weight of the lubricant composition. In an embodiment, the borate ester may be contained in the lubricant composition in an amount of 0.0001 to 0.2 weight percent, specifically 0.001 to 0.15 weight percent, more specifically 0.001 to 0.1 weight percent, based on a total weight of the lubricant composition. A representative commercially available borate ester is VANLUBE 289, available from R.T. Vanderbilt Co., Norwalk, Conn. Triisopropanolamine borate is also specifically mentioned.

The lubricant composition may also comprise diamond. The diamond may be a non-detonation diamond, such as high pressure high temperature diamond, chemical vapor deposition diamond, or ultrasound cavitation diamond, or a combination thereof, or a detonation diamond. A combination of the non-detonation diamond and the detonation diamond can be used. While not wanting to be bound by theory, it is understood that the diamond provides desirable burnishing properties and can act as nano-size ball bearings, resulting in reduced friction and preventing surface-to-surface contact by filling in imperfections in the moving surfaces. Also, because the diamond includes particles having a size on a nanometer scale, the diamond can aid in providing a surface having a similarly smooth surface. The diamond may have a particle size (e.g., largest particle diameter) of 2 to 50 nm, specifically 4 to 40 nm, more specifically 5 to 30 nm. Diamond having a particle size of 5 to 15 nm is specifically mentioned. The diamond may have an average particle size (e.g., an average largest particle diameter) of 8 to 1000 nm, specifically 10 to 800 nm, more specifically 12 to 600 nm. Also, the diamond may be contained in the lubricant composition in an amount of 0.01 to 3 weight percent (wt %), specifically 0.05 to 2 wt %, more specifically 0.1 to 1 wt %, based on the total weight of the lubricant composition. Also, the diamond may be present in the lubricant composition in an amount of 0.001 to 1 volume percent (vol %), specifically 0.01 to 0.5 vol %, more specifically 0.05 to 0.1 vol %, based on the total volume of the lubricant composition. The diamond particles may have a variety of shapes, and may be in the form of triangles, squares, spheres, hemispheres, rods, polygons, plates, rods, disks, or a combination thereof. The diamond may have various cross-sectional shapes, such as a rectangular, polygonal, oval, elliptical, or circular cross-sectional shape, or a combination thereof.

The lubricant composition may also comprise a boron oxide. While not wanting to be bound by theory, it is understood that the boron oxide bonds to metal surfaces to provide a hard wear-resistant and corrosion-resistant surface. Also, the particles of the boron oxide bound to the metal surface may be aligned in the direction of movement, further reducing friction.

The boron oxide may have a particle size (e.g., largest particle diameter) of 20 to 200 nm, specifically 30 to 180 nm, more specifically 40 to 160 nm. An embodiment wherein the boron oxide comprises particles having a diameter of 40 to 80 nm is specifically mentioned. The boron oxide may have an average particle size (e.g., an average largest particle diameter) of 20 to 1000 nm, specifically 30 to 800 nm, more specifically 40 to 600 nm. Also, the boron oxide may be contained in the lubricant composition in an amount of 0.01 to 3 weight percent (wt %), specifically 0.05 to 2 wt %, more specifically 0.1 to 1 wt %, based on the total weight of the lubricant composition. Alternatively, the boron oxide may be present in the lubricant composition in an amount of 0.001 to 1 volume percent (vol %), specifically 0.01 to 0.5 vol %, more specifically 0.05 to 0.1 vol %, based on the total volume of the lubricant composition. The boron oxide particles may have a variety of shapes, and may be in the form of triangles, squares, spheres, hemispheres, rods, polygons, plates, rods, disks, or a combination thereof. The boron oxide may have various cross-sectional shapes, such as a rectangular, polygonal, oval, elliptical, or circular cross-sectional shape, or a combination thereof.

In an embodiment, the lubricant composition may comprise an organic tungsten composition. While not wanting to be bound by theory, it is understood that the organic tungsten composition aids in forming a dispersion of the tungsten disulfide, the alkali metal borate, the borate ester, the diamond, and the boron oxide, each if present. In an embodiment, at least one of the tungsten disulfide, the alkali metal borate, the borate ester, the diamond, and the boron oxide form a colloidal dispersion in the organic tungsten composition. When a colloidal dispersion is formed, the dispersed particles, e.g., the tungsten disulfide, the alkali metal borate, the diamond, and the boron oxide, each if present, do not substantially settle and are therefore desirably present at the moving surfaces as opposed to forming a sediment. In addition, in the colloidal dispersion, the aggregation of particles is substantially or effectively prevented, further improving the activity or effectiveness of the tungsten disulfide, the alkali metal borate, the borate ester, the diamond, the boron oxide, and the organic tungsten composition.

Furthermore, as is further disclosed below, it has been unexpectedly found that certain combinations of the tungsten disulfide, the alkali metal borate, the borate ester, the diamond, the boron oxide, and the organic tungsten composition, when suitably dispersed, provide a synergistic improvement in lubrication properties. The synergistic improvement in lubrication properties are provided while maintaining or without substantial loss to other desirable properties, such as wear. While not wanting to be bound by theory, it is understood that the tungsten disulfide, the boron oxide, and the diamond synergistically provide a hard and very smooth surface on moving parts, resulting in reduced friction. Compositions comprising the tungsten disulfide, the boron oxide, and the diamond are specifically mentioned. Compositions comprising the tungsten disulfide, the alkali metal borate, and the borate ester are also specifically mentioned.

The organic tungsten composition may be a composition as described in U.S. Patent Publication No. 2008/0234154, the content of which is incorporated by reference herein in its entirety. The organic tungsten composition may comprise an organic tungsten complex that is a reaction product of a fatty acid compound and a tungsten salt, wherein the tungsten salt is a reaction product of an acidic tungsten and a nitrogenous base. In particular, the fatty acid compound may be a fatty amide and/or a monoglyceride. The organic tungsten complex may be prepared according to methods disclosed for the analogous organomolybdates in U.S. Pat. Nos. 4,889,647, 5,137,647, 5,412,130, and 7,205,423; the disclosures of which are incorporated herein by reference in their entirety. In an embodiment, the tungsten salt is an ammonium tungstate salt, and the fatty acid compound is a reaction product of a secondary amine and a fatty oil or a fatty acid.

Due to the complex nature of the organic tungsten complex, a specific chemical structure cannot be assigned, however for illustrative purposes a component of the organic tungsten composition can have a structure as shown in Formula 2.

(2)

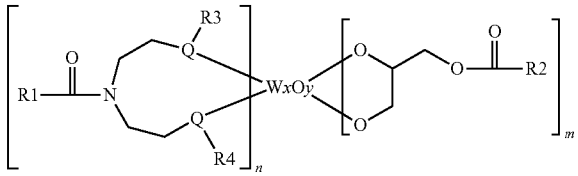

In Formula 2, R1 and R2 and are each independently a fatty oil residue, R3 and R4 are each independently hydrogen, a C1 to C25 alkyl group, a C1 to C18 alkoxy substituted alkyl group, or a C2 to C18 amino substituted alkyl group, Q is N or O, the sum of n and m is greater than or equal to 1, x is 1 to 12, and y is greater than or equal to x.

The organic tungsten composition may comprise 5 to 25 wt % tungsten, specifically 10 to 20 wt %, more specifically 12 to 18 wt % tungsten, based on the total weight of the organic tungsten composition. An example of the organic tungsten composition is VANLUBE W-324 (R.T. Vanderbilt Company, Inc., Norwalk, Conn.).

The organic tungsten composition may be contained in the lubricant composition in an amount of 10 to 99 wt %, specifically 20 to 98 wt %, more specifically 30 to 96 wt %, based on a total weight of the lubricant composition. Alternatively, the organic tungsten composition may be contained in the lubricant composition in an amount of 10 to 99 vol %, specifically 20 to 98 vol %, more specifically 30 to 96 vol %, based on a total volume of the lubricant composition.

In an embodiment, the lubricant composition may also comprise a dispersant. Use of the dispersant facilitates the formation of a dispersion, e.g., a colloidal dispersion, of the tungsten disulfide, the alkali metal borate, the borate ester, the diamond, the boron oxide, and the organic tungsten composition, each if present. As previously noted, it has been unexpectedly found that certain combinations of the tungsten disulfide, the alkali metal borate, the borate ester, the boron oxide, and the diamond, when suitably dispersed, provide a synergistic improvement in lubrication properties. In addition, the dispersant can prevent sludge, varnish, and other deposits by keeping particles suspended in a colloidal state. While not wanting to be bound by theory, the dispersant can perform these functions via one or more means selected from:

(1) solubilizing polar contaminants in their micelles; (2) stabilizing colloidal dispersions in order to prevent aggregation of their particles and their separation out of oil; (3) suspending such products, if they form, in the bulk lubricant; (4) modifying soot to minimize its aggregation and oil thickening; and (5) lowering surface/interfacial energy of undesirable materials to decrease their tendency to adhere to surfaces. The undesirable materials are typically formed as a result of oxidative degradation of the lubricant, the reaction of chemically reactive species such as carboxylic acids with the metal surfaces, or the decomposition of thermally unstable lubricant compositions such as, for example, extreme pressure agents.

In certain aspects, a dispersant molecule comprises three distinct structural features: (1) a hydrocarbyl group; (2) a polar group; and (3) a connecting group or a link. In certain embodiments, the hydrocarbyl group is polymeric in nature, and has a molecular weight of at or above 2000 Daltons (Da), in one embodiment, at or above 3000 Da, in another embodiment, at or above 5000 Da, and in yet another embodiment, at or above 8000 Da. A variety of olefins, such as polyisobutylene, polypropylene, polyalphaolefins, or a combination thereof, can be used to make a suitable polymeric dispersant. In certain embodiments, the polymeric dispersant is a polyisobutylene-derived or a polyester-derived dispersant. The number average molecular weight of the polyisobutylene or the polyester in such dispersants can be 500 and 3000 Da, specifically 800 to 2000 Da, more specifically 1000 to 2000 Da. In certain embodiments, the polar group in the dispersant is nitrogen or oxygen-derived. Nitrogen-based dispersants are typically derived from amines. The amines from which the nitrogen-based dispersants are derived are often polyalkylenepolyamines, such as, for example, diethylenetriamine and trethylenetetramine. Amine-derived dispersants are also called nitrogen- or amine-dispersants, while those derived from alcohol are also called oxygen or ester dispersants. Oxygen-based dispersants can be neutral and the amine-based dispersants can be basic.

Non-limiting examples of suitable dispersants include substituted or unsubstituted alkenyl succinimide, an alkenyl succinimide derived by post-treatment with ethylene carbonate or boric acid, a succiamide, succinate esters, succinate ester-amide, pentaerythritol, phenate-salicylate or an analog thereof, an alkali metal or mixed alkali metal salt thereof, an alkaline earth metal borates, a dispersion of a hydrated alkali metal borates, a dispersion of an alkaline-earth metal borate, a polyamide ashless dispersant, a benzylamine, a Mannich type dispersant, a phosphorus-containing dispersant, or a combination thereof.

Representative polymeric dispersants include poly(styrene-co-lauryl methacrylate-co-sulfoethyl methacrylate), poly(vinyltoluene-co-lauryl methacrylate-co-lithium methacrylate), poly(vinyltoluene-co-lauryl methacrylate-co-lithium methacrylate), poly(styrene-co-lauryl methacrylate-co-lithium methacrylate), poly(t-butylstyrene-co-styrene-co-lithium sulfoethyl methacrylate), poly(t-butylstyrene-co-lauryl methacrylate-co-lithium methacrylate), poly(t-butylstyrene-co-lithium methacrylate), poly(t-butylstyrene-co-lauryl methacrylate-co-lithium methacrylate-co-methacrylic acid), and poly(vinyltoluene-co-lauryl methacrylate-co-methacryloyloxyethyltrimethylammonium p-toluenesulfonate).

In an embodiment the dispersant is a polyester dispersant. The dispersant PERFAD 3000 (Croda, Inc., Edison, N.J.) is specifically mentioned.

The amount of the dispersant may be 0.01 wt % to 10 wt %, specifically 0.05 wt % to 7 wt %, more specifically 0.1 wt % to 4 wt %, based on the total weight of the lubricant composition. Some suitable dispersants have been described in Mortier et al., "Chemistry and Technology of Lubricants," 2nd Edition, London, Springer, Chapter 3, pages 86-90 (1996); and Leslie R. Rudnick, "Lubricant compositions: Chemistry and Applications," New York, Marcel Dekker, Chapter 5, pages 137-170 (2003), both of which are incorporated herein by reference in their entirety.

The lubricant composition can further comprise an additional chemical agent or other type of material to impart additional desired properties, e.g. a friction reducing agent, anti-wear or extreme-pressure agent, anti-corrosion agent, detergent, antioxidant, suspension agent, thixotropic agent, pour point depressant, or metal deactivator to define a lubricant composition suitable for use in a particular application.

The anti-wear additive (e.g., extreme pressure) can deposit a surface film to reduce wear. Extreme pressure additives can also react with a surface to reduce or prevent scuffing, galling, or seizure. As used herein, anti-wear additives include extreme pressure additives.

The anti-wear agent may be an organoboron anti-wear agent which comprises boron, and may comprise a borate ester (as further disclosed above), a boric acid, a borated epoxide, boron nitride, or a combination thereof. The organoboron anti-wear agent is desirably hydrolytically stable and provides improved anti-wear, anti-weld, extreme pressure, and/or friction properties and may also provide rust and corrosion inhibition for bearings and other metal engine components.

Examples of other suitable anti-wear agents include a phosphate ester, sulfurized olefin, a sulfur-containing anti-wear additive including a metal dihydrocarbyldithiophosphate (such as a zinc dialkyldithiophosphate), a thiocarbamate-containing compound including a thiocarbamate ester, an alkylene-coupled thiocarbamate, a bis(S-alkyldithiocarbamyl)disulfide. The dithiocarbamate-containing compound may be prepared by reacting a dithiocarbamate acid or salt with an unsaturated compound. The dithiocarbamate containing compound may also be prepared by simultaneously reacting an amine, carbon disulfide and an unsaturated compound. Dithiocarbamate compounds are described in U.S. Pat. Nos. 4,758,362 and 4,997,969, the contents of which are incorporated herein by reference in their entirety.

The lubricant composition may also comprise an anti-scuff agent comprising a metal dithiophosphate, a metal dithiocarbamate, a metal dialkyldithiophosphate, a metal dialkyldithiocarbamate, or a combination thereof. A metal of the anti-scuff agent may be zinc, antimony, lead, molybdenum, or a combination thereof. An embodiment in which the metal of the anti-scuff agent is antimony is specifically mentioned. The anti-scuff agent may be provided in the form of a solution or suspension of the anti-scuff agent in a base oil. A representative anti-scuff agent is Octopol AD, available from Tiarco Chemical.

The lubricant composition may also comprise an ashless anti-wear agent, and may comprise a monoester of a polyol and an aliphatic carboxylic acid, such as a C12 to C24 aliphatic carboxylic acid. The monoester of the polyol and the aliphatic carboxylic acid may be in the form of a mixture with an oil such as sunflower oil, or the like, which may be present in the ashless anti-wear agent mixture. Representative polyols include ethylene glycol, propylene glycol, glycerol, butanediol, hexanediol, sorbitol, arabitol, mannitol, sucrose, fructose, glucose, cyclohexane diol, erythritol, or pentaerythritol. Examples of the carboxylic acid include dodecanoic acid, stearic acid, lauric acid, behenic acid, and oleic acid.

The lubricant composition may also comprise a fluoride anti-wear agent. Representative fluoride anti-wear agents include lithium fluoride (LiF), sodium fluoride (NaF), potassium fluoride (KF), rubidium fluoride (RbF), cesium fluoride (CsF), magnesium fluoride ($MgF_2$), calcium fluoride ($CaF_2$), strontium fluoride ($SrF_2$), yttrium fluoride ($YF_3$), lanthanum fluoride ($LaF_3$), cerium fluoride ($CeF_3$), neodymium fluoride ($NdF_3$), europium fluoride ($EuF_3$), dysprosium fluoride ($DyF_3$), or a combination thereof.

The anti-wear agent may be present in an amount of 1 to 60 wt %, specifically 3 to 50 wt %, more specifically 5 to 40 wt %, based on the total weight of the lubricant composition.

A combination comprising one or more of the foregoing anti-wear agents can be used. An embodiment comprising a first anti-wear agent and a second anti-wear agent, wherein the first anti-wear agent is an organoboron anti-wear agent and the second anti-wear agent is $LaF_3$, is specifically mentioned.

The lubricant composition may further comprise a suspension agent, e.g., a thixotropic material, which may be included to uniformly suspend the components of the lubricant composition. Suitable suspension agents include, without limitation, silica, clay, organic thickeners, or mixtures thereof. Suitable organic thickeners can include, without limitation, a metal or mineral soap or complex soap, a polyurea, another polymer, or a combination thereof. Representative soaps or soap complexes include an aluminum benzoate-stearate complex, an aluminum benzoate-behenate-arachidate complex, a lithium azelate-stearate complex, a lithium sebecate-stearate or behenate complex, a lithium adipate-stearate complex, a calcium acetate-stearate complex, and a calcium sulfonate-stearate complex. Other aluminum, calcium, lithium, or other mineral soaps or complex soaps and combinations thereof can equally well be used.

The thixotropic agent can include, without limitation, a polyalphaolefin, polybutene, polyolester, vegetable oil, animal oil, another essential oil, or a combination thereof. The polyalphaolefin (PAO) can include, without limitation, a polyethylene, polypropylene, polybutene, polypentene, polyhexene, polyheptene, a higher PAO, a copolymer thereof, or a combination thereof. PAOs sold by ExxonMobil Chemical Company as SHF fluids and PAOs sold by BP-Amoco Chemical under the name Durasyn are specifically mentioned. Suitable polybutenes include, without limitation, those sold by BP Amoco Chemical Company and ExxonMobil Chemical Company under the trade names INDOPOL and PARAPOL, respectively. BP Amoco's INDOPOL 100 is specifically mentioned. A representative polyolester includes, without limitation, a neopentyl glycol, a trimethylolpropane, a pentaerythriol, a dipentaerythritol, a diester such as dioctylsebacate (DOS), diactylazelate (DOZ), or dioctyladipate. A suitable petroleum based fluid includes, without limitation, white mineral oil, a paraffinic oil, or a naphthenic oil having a viscosity of 5 to 600 centistokes at 40° C. A suitable vegetable oil includes, without limitation, castor oil, corn oil, olive oil, sunflower oil, sesame oil, peanut oil, another vegetable oil, a modified vegetable oil such as a cross-linked castor oil, or a combination thereof. Other essential oils will work as well. A combination comprising at least one of the above identified oils can be used.

The suspension agent can be used in an amount sufficient to provide a suitable viscosity and other suspension properties. The amount of the suspension agent may be 0.01 to 10 wt %, specifically 0.05 to 7 wt %, more specifically 0.1 to 4 wt %, based on the total weight of the lubricant composition.

The lubricant composition disclosed herein can optionally comprise a friction modifier that can further improve the friction between moving parts. The friction modifier can be a long-chain molecule with a polar end group and a nonpolar linear hydrocarbon chain. The polar end group can either physically adsorb onto the metal surface or chemically react with it, while the hydrocarbon chain can extend into the lubricant. The chains associate with one another and the lubricant to form a strong lubricant film.

Non-limiting examples of suitable friction modifiers include a fatty carboxylic acid; a derivative (e.g., alcohol, ester, borated ester, amide, or metal salt) of a fatty carboxylic acid; a mono-, di-, or tri-alkyl substituted phosphoric acid or phosphonic acid; a derivative (e.g., ester, amide, or metal salt) of mono-, di-, or tri-alkyl substituted phosphoric acid or phosphonic acid; a mono-, di-, or tri-alkyl substituted amine; mono- or di-alkyl substituted amide, or a combination thereof.

In an embodiment, the friction modifier is a saturated C13 to C18 fatty acid. The amount of the friction modifier may be 0.01 to 10 wt %, specifically 0.05 to 5 wt %, more specifically 0.1 to 3 wt %, based on the total weight of the lubricant composition. Some suitable friction modifiers have been described in Mortier et al., "Chemistry and Technology of Lubricants," 2nd Edition, London, Springer, Chapter 6, pages 183-187 (1996); and Leslie R. Rudnick, "Lubricant compositions: Chemistry and Applications," New York, Marcel Dekker, Chapters 6 and 7, pages 171-222 (2003), both of which are incorporated herein by reference in their entirety.

The lubricant composition can optionally comprise a pour point depressant that can lower the pour point of the lubricant composition. In an embodiment the pour point depressant possess a polymeric structure; a waxy and non-waxy component; a comb structure comprising a short backbone with long pendant groups; a broad molecular weight distribution; or a combination thereof. Non-limiting examples of suitable pour point depressants include a polymethacrylate, an alkyl acrylate polymer, an alkyl methacrylate polymer, an alkyl fumarate polymer, a di(tetra-paraffin phenol)phthalate, a condensate of tetra-paraffin phenol, a condensate of a chlorinated paraffin with naphthalene, an alkylated naphthalene, a styrene ester, an oligomerized alkyl phenol, a phthalic acid ester, an ethylene-vinyl acetate copolymer, or a combination thereof. In an embodiment the pour point depressant is a tetra (long-chain) alkyl silicate, phenyltrstearyloxysilane, or a pentaerythritol tetrastearate. In an embodiment, the pour point depressant comprises an ethylene-vinyl acetate copolymer, a condensate of chlorinated paraffin and phenol, polyalkyl styrene, or a combination thereof. The amount of the pour point depressant may be 0.01 to 10 wt %, specifically 0.05 to 5 wt %, more specifically 0.1 to 3 wt %, based on the total weight of the lubricant composition. Some suitable pour point depressants have been described in Mortier et al., "Chemistry and Technology of Lubricants," 2nd Edition, London, Springer, Chapter 6, pages 187-189 (1996); and Leslie R. Rudnick, "Lubricant compositions: Chemistry and Applications," New York, Marcel Dekker, Chapter 11, pages 329-354 (2003), both of which are incorporated herein by reference in their entirety.

The lubricant composition can optionally comprise a foam inhibitor or an anti-foam agent that can break up a foam in a lubricant. Non-limiting examples of suitable anti-foam agents include a silicone oil or a polydimethylsiloxane, a fluorosilicone, an alkoxylated aliphatic acid, a polyether (e.g., polyethylene glycol), a branched polyvinyl ether, an alkyl acrylate polymer, an alkyl methacrylate polymer, a polyalkoxyamine, or a combination thereof. In an embodiment, the anti-foam agent comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the anti-foam may be 0.01 to 5 wt %, specifically 0.05 to 3 wt %, more specifically 0.1 to 1 wt %, based on the total weight of the lubricant composition. Some suitable anti-foam agents have been described in Mortier et al., "Chemistry and Technology of Lubricants," 2nd Edition, London, Springer, Chapter 6, pages 190-193 (1996), which is incorporated herein by reference in their entirety.

In an embodiment, the lubricant composition comprises a metal deactivator, e.g., a compound which reduces the activity of the metal. Some non-limiting examples of suitable metal deactivators include disalicylidene propylenediamine, a triazole, a thiadiazole, or a mercaptobenzimidazole.

Optionally, the lubricant composition can further comprise an antioxidant effective to reduce or prevent the oxidation of the base oil. Examples of the anti-oxidants include, but are not limited to, a phenol type (phenolic) oxidation inhibitor, such as 4,4'-methylene bis(2,6-di tert butylphenol), 4,4'-bis(2,6-di tert-butylphenol), 4,4'-bis(2 methyl 6 tert butylphenol), 2,2'-methylene bis(4-methyl 6 tert butylphenol), 4,4'-butylidene bis(3 methyl 6 tert butylphenol), 4,4'-isopropylidene bis(2,6 di tert butylphenol), 2,2'-methylene bis(4-methyl 6 nonylphenol), 2,2'-isobutylidene bis(4,6 dimethylphenol), 2,2'-5 methylene bis(4 methyl 6 cyclohexylphenol), 2,6-di tert butyl 4-methylphenol, 2,6-di tert butyl 4 ethylphenol, 2,4-dimethyl 6 tert butyl-phenol, 2,6-di tert 1 dimethylamino p cresol, 2,6-di tert 4 (N,N'-dimethylaminomethylphenol), 4,4'-thiobis(2 methyl 6 tert butylphenol), 2,2'-thiobis(4 methyl 6 tert butylphenol), bis(3 methyl 4 hydroxy 5 tert-10 butylbenzyl) sulfide, bis(3,5 di tert butyl 4 hydroxybenzyl), or a combination thereof. Diphenylamine type oxidation inhibitors include, but are not limited to, alkylated diphenylamine, phenyl alpha naphthylamine, and alkylated alpha naphthylamine, sulfur-based antioxidants (e.g., dilauryl-3,3'-thiodipropionate or a sulfurized phenolic antioxidant), a phosphorous-containing antioxidant (e.g., a phosphites), a zinc dithiophosphate, an oil-soluble copper compound, or a combinations thereof. Other types of oxidation inhibitors include metal dithiocarbamate (e.g., zinc dithiocarbamate), and 15 methylenebis(dibutyldithiocarbamate). The amount of the antioxidant may be 0.01 to 10 wt %, specifically 0.05 to 5 wt %, more specifically 0.1 to 3 wt %, based on the total weight of the lubricant composition. Some suitable antioxidants have been described in Leslie R. Rudnick, "Lubricant compositions: Chemistry and Applications," New York, Marcel Dekker, Chapter 1, pages 1-28 (2003), which is incorporated herein by reference in their entirety.

The lubricant composition can further comprise a rust inhibitor. The rust inhibitor can attach onto a metal surface to form an impenetrable protective film, and can be physically or chemically adsorbed to the surface. Specifically, and while not wanting to be bound by theory, it is understood that film formation can occurs when the additive interacts with the metal surface via a polar group and associates with the lubricant (e.g., base oil) via a nonpolar group. Suitable rust inhibitors may include, for example, various nonionic polyoxyethylene surface active agents such as polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate. Suitable rust inhibitors may further include other compounds such as, for example, a monocarboxylic acid (e.g., 2-ethylhexanoic acid, lauric acid, myristic acid, palmitic acid, oleic acid, linoleic acid, linolenic acid, behenic acid, or cerotic acid), an oil-soluble polycarboxylic acid (e.g., those produced from a fatty acids, oleic acid, or linoleic acid), an alkenylsuccinic acid in which the alkenyl group contains 10 or more carbon atoms (e.g., tetrapropenylsuccinic acid, tetradecenylsuccinic acid, or hexadecenylsuccinic acid); a long-chain alpha,omega-dicarboxylic acids having a molecular weight in the range of 600 to 3000 Daltons, or a combination thereof. Further examples of rust agents include a metal soap, a fatty acid amine salt, a metal salt of a sulfonic acid, partial carboxylic acid ester of polyhydric alcohol, or a phosphoric ester.

The amount of the rust inhibitor may be 0.01 to 10 wt %, specifically 0.05 to 5 wt %, more specifically 0.1 to 3 wt %, based on the total weight of the lubricant composition.

The lubricant composition can have a pour point of −60° C. to 0° C.; specifically −55° C. to −10° C.; more specifically −50° C. to −20° C. The lubricant composition can have a shear stability index (SSI) of 2 to 50, specifically 3 to 45, more specifically 4 to 40, when determined according to ASTM 3945, wherein lower values signify that a material is more shear stable.

The lubricant composition may have a Brookfield viscosity of 10,000 to 1,000,000 centipoise (cP), specifically 20,000 to 500,000 cP, more specifically 30,000 to 250,000 cP.

In an embodiment, the lubricant composition can have a low temperature viscosity when determined with a Mini Rotary Viscometer (MRV) at −25° C. of 5,000 to 25,000 cP, specifically 6,000 to 20,000 cP, more specifically 8,000 to 19,000 cP.

The lubricant composition also comprises a base oil in which the tungsten disulfide, the alkali metal borate, the borate ester, the boron oxide, the organic tungsten composition, and the diamond, each if present, are dispersed. The base oil comprises a base stock of Groups I-V as specified in the American Petroleum Institute (API) Publication 1509, Fourteenth Edition, December 1996 (i.e., API Base Oil Interchangeability Guidelines for Passenger Car Motor Oils and Diesel Engine Oils), which is incorporated herein by reference in its entirety. The API guideline defines a base stock as a lubricant component that may be manufactured using a variety of different processes. Groups I (solvent refined mineral oils), II (hydrocracked mineral oils) and III (severely hydrocracked based oils) base stocks are mineral oils, each with specific ranges of the amount of saturates, sulfur content, and viscosity index. Group IV base stocks are polyalphaolefins (PAOs). Group V base stocks include all other base stocks not included in Group I, II, III, or IV and include esters and naphthenes. A vegetable oil may be used. In an embodiment, the base oil comprises a base stocks in Groups I, II, III, IV, V, or a combination thereof. The base oil may have a kinematic viscosity of 2.5 to 20 centistokes (cSt), specifically 4 cSt to 20 cSt, more specifically 5 cSt to 16 cSt at 100° C.

The base oil may comprise a natural oil having a viscosity suitable for lubrication, a synthetic oil having a viscosity suitable for lubrication, or a combination thereof. In an embodiment, the base oil includes a base stock obtained by isomerization of a synthetic wax and a slack wax, as well as hydrocrackate base stock produced by hydrocracking (rather than solvent extracting) the aromatic and polar components of crude oil. In another embodiment, the base oil of lubricating viscosity includes a natural oil such as an animal oil, vegetable oil, mineral oil (e.g., liquid petroleum oil or solvent treated or acid-treated mineral oil of the paraffinic, naphthenic, or mixed paraffinic-naphthenic types), an oil derived from coal or shale, or a combination thereof. Some non-limiting examples of animal oils include bone oil, lanolin, fish oil, lard oil, dolphin oil, seal oil, shark oil, tallow oil, and whale oil. Some non-limiting examples of vegetable oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and meadow foam oil. Such oils may be partially or fully hydrogenated.

In an embodiment the synthetic oil of lubricating viscosity includes a hydrocarbon oil and a halo-substituted hydrocarbon oil such as a polymerized and/or cross-linked olefin, an alkylbenzene, a polyphenyl, an alkylated diphenyl ether, an alkylated diphenyl sulfide, a derivative, analogues or homologues thereof, or a combination thereof. In another embodiment the synthetic oil includes an alkylene oxide polymer, a cross-linked polymer, a copolymer, or a derivative thereof wherein the terminal hydroxyl groups can be modified by esterification or etherification. In another embodiment the synthetic oil include the ester of a dicarboxylic acids with a variety of alcohols. In an embodiment the synthetic oil include as ester made from a C5 to C12 monocarboxylic acid and a polyol and a polyol ether. In another embodiment the synthetic oil includes a tri-alkyl phosphate ester oil such as tri-n-butyl phosphate or tri-iso-butyl phosphate.

In some embodiments, the synthetic oil includes a silicon-based oil (such as the polyalkyl-, polyaryl-, polyalkoxy-, polyaryloxy-siloxane oil or silicate oil). In other embodiment the synthetic oil includes a liquid ester of a phosphorus-containing acid, a polymeric tetrahydrofuran, or a polyalpha-olefin.

A base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

In a further embodiment, the base oil comprises a poly-alpha-olefin (PAO). Non-limiting examples of suitable poly-alpha-olefins include those derived from octene, decene, or a combination thereof. The polyalphaolefin may have a viscosity of 2 to 15, specifically 2.5 to 10, more specifically 3 to 7 centistokes, or 3.5 to 6 centistokes at 100° C. In some instances, the poly-alpha-olefin may be used together with another base oil such as a mineral oil. A polyalphaolefin comprising 1-decene is specifically mentioned. In an embodiment the polyalphaolefin comprises 75% to 85% decene trimer, 3% to 23% decene tetramer, and 0.1 to 4% pentamer or higher oligomer. SYNFLUID, a product of Chevron Phillips Chemical Company, specifically SYNFLUID PAO 4 cSt is specifically mentioned.

In an embodiment the base oil comprises a polyalkylene glycol or a polyalkylene glycol derivative, where a terminal hydroxyl group of the polyalkylene glycol may be modified by esterification, etherification, or acetylation. Non-limiting examples of suitable polyalkylene glycols include polyethylene glycol, polypropylene glycol, polyisopropylene glycol, or a combination thereof. Non-limiting examples of suitable polyalkylene glycol derivatives include an ether of a polyalkylene glycol (e.g., methyl ether of polyisopropylene glycol, diphenyl ether of polyethylene glycol, or diethyl ether of polypropylene glycol), a mono- and polycarboxylic ester of a polyalkylene glycol, or a combination thereof. In some instances, the polyalkylene glycol or polyalkylene glycol derivative may be used together with a base oil such as poly-alpha-olefin or a mineral oil.

In another embodiment the base oil comprises an ester of a dicarboxylic acid (e.g., phthalic acid, succinic acid, an alkyl succinic acid, an alkenyl succinic acid, maleic acid, azelaic acid, suberic acid, sebacic acid, fumaric acid, adipic acid, linoleic acid dimer, malonic acid, an alkyl malonic acid, or an alkenyl malonic acid) with an alcohol (e.g., butyl alcohol, hexyl alcohol, dodecyl alcohol, 2-ethylhexyl alcohol, ethylene glycol, diethylene glycol monoether, or propylene glycol). Non-limiting examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, or the 2-ethylhexyl diester of linoleic acid dimer.

In another embodiment the base oil comprises a hydrocarbon prepared by the Fischer-Tropsch process. The Fischer-Tropsch process provides a hydrocarbon from gases containing hydrogen and carbon monoxide using a Fischer-Tropsch catalyst. These hydrocarbons may require further processing in order to be useful as a base oil. For example, the hydrocarbon may be dewaxed, hydroisomerized, and/or hydrocracked.

In another embodiment, the base oil comprises an unrefined oil, a refined oil, a rerefined oil, or a combination thereof. An unrefined oil is obtained directly from a natural or synthetic source without further purification treatment. Non-limiting examples of the unrefined oil includes a shale oil obtained directly from a retorting operation, a petroleum oil obtained directly from primary distillation, or an ester oil obtained directly from an esterification process and used without further treatment. A refined oil is similar to the unrefined oil except that the former have been further treated by one or more purification processes to improve one or more properties. Such processes include solvent extraction, secondary distillation, acid or base extraction, filtration, and percolation. The rerefined oil is obtained by applying to a refined oil processes similar to those used to obtain the refined oil. Such rerefined oils are also known as reclaimed or reprocessed oils and often are additionally treated by processes directed to removal of spent additives and oil breakdown products.

An embodiment in which the base oil is an olefin, specifically a polyalphaolefin, more specifically polyalphaolefin 4 (PAO4), is specifically mentioned.

The base oil may comprise 1 weight percent (wt %) to 100 wt %, specifically 2 wt % to 98 wt %, more specifically 4 weight percent (wt %) to 96 wt % of the olefin. An embodiment in which the base oil consists of PAO4 is specifically mentioned. In an embodiment, the base oil may have a viscosity of 1 to 25, specifically 2 to 20, more specifically 3 to 15 centistokes at 100° C. A polyalphaolefin having a viscosity of 4 centistokes at 100° C. is specifically mentioned.

The total of the tungsten disulfide, the alkali metal borate, the borate ester, the diamond, the boron oxide, and the organic tungsten composition, each if present, may be combined in a weight ratio to the base oil of 1:1 to 1:1000, specifically 1:2 to 1:500, more specifically 1:3 to 1:250, or 1:4 to 1:125. An embodiment wherein the total of the tungsten disulfide, the alkali metal borate, the borate ester, the diamond, the boron oxide, and the organic tungsten composition, each if present, are combined in a weight ratio to the base oil of 1:32 is specifically mentioned. In an embodiment, the base oil may be contained in the lubricant composition in an amount of 5 to 99.99 wt %, specifically 10 to 99.9 wt %, more specifically 15 to 99 wt %, based on a total weight of the lubricant composition.

The lubricant composition can have a pour point of −60° C. to 0° C.; specifically −55° C. to −10° C.; more specifically −50° C. to −20° C. The lubricant can have a shear stability index (SSI) of 2 to 50, specifically 3 to 45, more specifically 4 to 40, when determined according to ASTM 3945, wherein lower values signify that a material is more shear stable. The lubricant may have a Brookfield viscosity of 10,000 to 1,000,000 centipoise (cP), specifically 20,000 to 500,000 cP, more specifically 30,000 to 250,000 cP. In an embodiment, the lubricant can have a low temperature viscosity when determined with a Mini Rotary Viscometer (MRV) at −25° C. of 5,000 to 25,000 cP, specifically 6,000 to 20,000 cP, more specifically 8,000 to 19,000 cP.

A method of manufacturing the lubricant composition comprises contacting tungsten disulfide having a particle size of 4 to 160 nanometers, an alkali metal borate, a borate ester, and a base oil under conditions effective to disperse the tungsten disulfide, the alkali metal borate, and the borate ester in the base oil to manufacture the lubricant composition.

Another method of manufacturing the lubricant composition comprises: contacting tungsten disulfide having a particle size of 4 to 80 nm, diamond having a particle size of 2 to 50 nm, boron oxide comprising particles having a diameter of 20 to 200 nm, an organic tungsten composition, and a base oil under conditions effective to disperse the tungsten disulfide, the diamond, the boron oxide, and the organic tungsten composition in the base oil to manufacture the lubricant composition.

In addition to the tungsten disulfide, the alkali metal borate, the borate ester, the diamond, and the boron oxide, each if present, an additional chemical agent or other type of material, e.g., a friction reducing agent, anti-wear or extreme-pressure agent, anti-corrosion agent, detergent, antioxidant, suspension agent, thixotropic agent, pour point depressant, or metal deactivator can be further included in the lubricant composition.

The conditions effective to disperse the tungsten disulfide, the diamond, and the boron oxide in the organic tungsten composition may provide a colloidal dispersion, and may comprise mixing with an ultrasonic mixer or a high-shear mixer. The dispersion may be provided by mixing, blending, or otherwise combining the tungsten disulfide, the alkali metal borate, the borate ester, the diamond, the boron oxide, and the organic tungsten composition, each if present, and the base oil. The contacting may comprise mixing in a suitable mixer, such as a ball mill, a colloid mill, an ultrasonic mixer, a planetary mixer, a Hobart® mixer, a Henschel mixer, a KADY mill, or a SONOLATOR. In a mixer with rotary action, such as a planetary mixer or a KADY mill, the mixing may be at a suitable rate, such as at 2000 to 12000 revolutions per minute (RPM), specifically 2500 to 10000 RPM, more specifically 3000 to 9000 RPM. If an ultrasonic mixer such as a SONOLATOR is used, mixing can be at a suitable energy, such as a setting of 4 to 6, specifically a setting of 5 on a SONOLATOR mixer provided by Sonic Corporation of Stratford, Conn. The contacting may be conducted for a suitable time, specifically 0.01 to 10 hours, specifically 0.1 to 8 hours, more specifically 0.3 to 4 hours, and at a suitable temperature, specifically 25 to 150° C., specifically 30 to 125° C., more specifically 35 to 100° C. Examples of high shear mixers include a TMN turbo batter mixer which is available from Franz Haas Waffelmaschinen, Industriegesellschaft M.B.H. of Vienna, Austria, or a Daymax mixer available from LeBlond, Inc. A Daymax mixer fitted with a 7" diameter dispersion blade is specifically mentioned. To form the lubricating composition, the components may be contacted, e.g., mixed, in a high-shear mixing step. In the high-shear mixing step, the mixer may be operated at 2000 to 12000 revolutions per minute (RPM), specifically 2500 to 11000 RPM, more specifically 3000 to 10000 RPM, and may be operated for 0.01 to 10 hours, specifically 0.1 to 8 hours, more specifically 0.3 to 4 hours at 25 to 150° C., specifically 30 to 125° C., more specifically 35 to 100° C. The high-shear mixing step may be followed by a first low-shear mixing step. The first low-shear mixing step may be performed using the same mixer, and in the first low-shear mixing step the mixer may be operated at 100 to 2000 revolutions per minute (RPM), specifically 200 to 1800 RPM, more specifically 300 to 1600 RPM, and may be operated for 0.01 to 10 hours, specifically 0.1 to 8 hours, more specifically 0.3 to 4 hours at 25 to 150° C., specifically 30 to 125° C., more specifically 35 to 100° C.

The lubricant composition may be optionally settled by allowing the lubricant composition to stand un-agitated. The settling can be an effective means to remove particles that cannot be dispersed, for example particles having an undesirably large particle size. The settling may be conducted for 1 to 48 hours, specifically 2 to 24 hours, more specifically 3 to 12 hours.

Also, the lubricant composition may be optionally filtered, either before or after the settling. The filtering may be performed by passing the first mixture through a filter. The filter may have a maximum pore size of 10 micrometers (μm), specifically 1 μm, more specifically 0.5 μm.

The lubricant composition may be combined with another agent or material, e.g. a friction reducing agent, anti-wear or extreme-pressure agent, anti-corrosion agent, detergent, antioxidant, suspension agent, thixotropic agent, pour point depressant, or metal deactivator to form a second mixture. In an embodiment, the lubricant composition is combined with the anti-wear agent. The combining can comprise mixing with the high-shear mixer in a second low-shear mixing step in which the mixer may be operated at 100 to 2000 revolutions per minute (RPM), specifically 200 to 1800 RPM, more specifically 300 to 1600 RPM, and may be operated for 0.01 to 10 hours, specifically 0.1 to 8 hours, more specifically 0.3 to 4 hours at 25 to 150° C., specifically 30 to 125° C., more specifically 35 to 100° C.

In addition, a second high-shear mixing step may be performed. In the second high-shear mixing step, the mixer may be operated at 2000 to 12000 revolutions per minute (RPM), specifically 2500 to 11000 RPM, more specifically 3000 to 10000 RPM, and may be operated for 0.01 to 10 hours, specifically 0.1 to 8 hours, more specifically 0.3 to 4 hours at 25 to 150° C., specifically 30 to 125° C., more specifically 35 to 100° C.

In an embodiment the lubricant composition can be used either alone or in conjunction with an additional quantity of a base oil. For example, the lubricant composition can be disposed on a surface, such as a surface of a firearm, an axel, or a bearing, to provide desirable lubricating properties. Alternatively, the lubricant composition can be combined with a synthetic or natural oil to provide an engine lubricant. When used as an engine lubricant, the lubricant composition may be introduced in an engine as a component of the motor oil.

In another embodiment, the lubricant composition can be used as a restorative or cleaning agent. It has been surprising observed that when an engine containing the lubricant composition is operated, the components of the engine are polished and surface blemishes or imperfections, such as pits, are removed from the surfaces of moving parts of the engine. In addition, parts treated with the lubricant composition are surprisingly free of debris or other build-up after operation of the engine treated with the lubricant composition. While not wanting to be bound by theory, it is understood that the lubricant composition provides this surprising effect by forming a hard and smooth microscopic coating on the surface of the moving parts and by sequestering or suspending materials which would otherwise form a deposit on the engine components. Also, it is understood that because the lubricant composition provides a surface which is microscopically smooth, debris cannot adhere to the surfaces of the engine components after treatment. Such treatment can include contacting the surface with the lubricant composition, e.g., by adding the lubricant composition to the engine oil, and moving the surface, e.g., by operating the engine.

Specifically, a surface of a component treated with the lubricant composition (e.g., a restored surface) can have an arithmetic mean surface roughness Ra of less than 0.3 μm, specifically less than 0.2 μm, more specifically less than 0.1 μm. In an embodiment the surface roughness Ra of a component treated with the lubricant composition is 0.01 to 0.3 μm, specifically 0.2 to 3 μm.

In another embodiment, the composition is useful as a polish. The polish can effectively remove surface irregularities. Further, the polish can provide a shiny surface. A method of polishing includes contacting a surface with a polish, and moving the contacted surface against another surface, wherein the polish comprises the lubricant composition. Exemplary surfaces that can be polished by the polish include a metal, glass, or plastic surface.

In an embodiment, the lubricant composition is useful as a lubricant for a mechanical device, such as a bicycle chain or a hinge. In a specifically mentioned embodiment, the lubricant composition is useful as a firearm cleaner-lubricant-protectant. A firearm may be cleaned, lubricated, and protected by contacting the firearm with the lubricant composition. In an embodiment, a firearm may be cleaned by disposing the lubricant composition on a suitable applicator, and the firearm contacted with the applicator having the lubricant composition disposed thereon. In another embodiment, a method of cleaning a firearm comprises disposing the lubricant composition on a suitable applicator, and urging the applicator having the lubricant composition disposed thereon through a bore of the firearm. Thus, for example, to clean a bore of a firearm, the applicator, having a size, e.g., diameter, suitable for the bore to be cleaned, may be pulled through the bore of the firearm.

The applicator may be any suitable applicator for cleaning a firearm. The applicator may comprise a towel, towellette, wipe, rope, string, brush, boresnake, or a combination thereof. The applicator may comprise any suitable synthetic fiber, natural fiber, or combination thereof. The applicator may comprise polyethylene, polyester, polypropylene, polyurethane, cotton, hemp, bamboo, or a combination thereof. The applicator may be partially saturated, or saturated with the lubricant composition. The applicator may have any suitable size, and for example may have a length and a width which are each independently 1 centimeter (cm) to 1 meter (m), specifically 2 cm to 500 cm, and a thickness of 0.01 cm to 5 cm, specifically 0.1 cm to 1 cm.

Also disclosed is a firearm cleaning system comprising: a container, an applicator disposed in the container; and the lubricant composition disposed on the applicator. The container may be any suitable container, and may be a plastic case, a metal case, a plastic bag, a packet, or a pouch. In an embodiment, the container comprises a thermoplastic film, e.g., polypropylene or polyethylene, a metal foil, a laminate, a metallized film, or a combination thereof. Suitable materials for the container are those that are sufficiently resistant and impermeable to the lubricant composition, provide suitable flexibility, and provide suitable sealing properties. The container desirably provides suitable sealing properties so that the lubricant composition does not leak therefrom, and the lubricant composition is protected from contamination. Also, the container desirably substantially or effectively prevents evaporation of any volatile components of the lubricant composition that may be present. The container may be a zippered pouch, a pouch having a re-useable adhesive, or a pouch having a hook-and-loop fastener, for example. A single-use, disposable, tear-open pouch is specifically mentioned. The tear-open pouch may be provided by thermally bonding polymeric or laminate sheets which comprise a thermoplastic, for example. The tear-open pouch may comprise a score, seam, or perforation to facilitate opening of the pouch. The container may have any suitable shape, and may be rectilinear or curvilinear, and may be square, rectangular, circular, triangular, or a combination thereof. Also, the container may have any suitable dimensions.

The single-use tear-open pouch may be particularly advantageous in adverse conditions where contamination, such as from blown sand, can occur. Use of a single-use pouch can prevent contamination of unopened firearm cleaner. In addition, for example in very cold conditions where warming of larger quantities of the lubricant composition may be difficult, a single-use pouch can provide added convenience.

Figure 7:
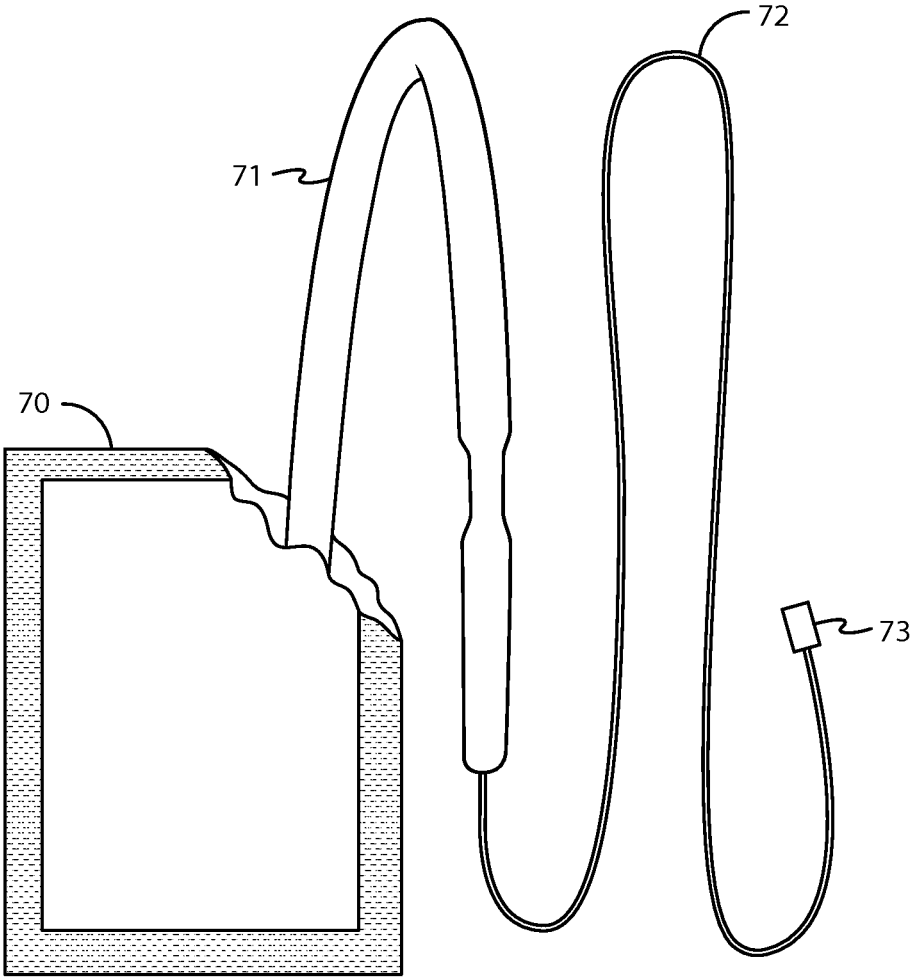
FIG. 7 is a schematic diagram of a firearm cleaning system.

An embodiment of the firearm cleaning system is shown in FIG. 7. The firearm cleaning system may comprise a pouch 70 and an applicator 71 on which the lubricant composition is disposed. The firearm cleaning system may further comprise a string 72 and a weight 73.

Also provided is a firearm cleaning kit, the kit comprising an applicator and the lubricant composition within a suitable container.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

EXAMPLES

Example 1

Organic tungsten solution, 2.36 liters (VANLUBE W-324, R.T. Vanderbilt Co., Norwalk, Conn.); nanoparticle tungsten disulfide, 15 grams (g) (8.2-2000 nm tungsten disulfide, Shanghai Zdan International Co. Ltd., Shanghai City, China); nanoparticle boron oxide, 15 g (No. 1220, GFS Chemicals, Inc. Powell, Ohio); and nanoparticle diamond, 10 g (Nanodiamond 4-15 nm, Henan Huier Nano Technology Co., Ltd., Zhengzhou City, China) where combined with a Daymax Disperser Lab Unit equipped with a 7" diameter Daymax dispersion blade at 1200 RPM for 1 hour at 85° C. to form a first mixture. The first mixture was then allowed to settle for 24 hours. After the settling for 24 hours, an organo borate ester, 1.42 liters (Vanlube 289, R.T. Vanderbilt, Norwalk, Conn.), was added to the settled first mixture to form a second mixture. The second mixture was mixed with the Daymax mixer at 1200 RPM for 1 hour at 85° C., and then allowed to settle for 24 hours. The settled second mixture was filtered with a 1 micron filter to provide a lubricant composition.

Example 2

Organic tungsten solution, 2.36 liters (VANLUBE W-324, R.T. Vanderbilt Co., Norwalk, Conn.); nanoparticle tungsten disulfide, 15 g (8.2-2000 nm, Shanghai Zdan International Co. Ltd., Shanghai City, China); nanoparticle lanthanum trifluoride, 25 g (Nano $LaF_3$, Henan Huier Nano Technology Co., Ltd., China); nanoparticle boron oxide, 15 g (No. 1220, GFS Chemicals, Inc. Powell, Ohio); and nanoparticle diamond, 10 g (Nano-diamond 4-15 nm, Henan Huier Nano Technology Co., Ltd., Zhengzhou City, China) where combined with a Daymax Disperser Lab Unit equipped with a 7" diameter Daymax dispersion blade at 1200 RPM for 1 hour at 85° C. to form a first mixture. The first mixture was then allowed to settle for 24 hours. After the settling for 24 hours, an organo borate ester, 1.42 liters (Vanlube 289, R.T. Vanderbilt, Norwalk, Conn.), was added to the settled first mixture to form a second mixture. The second mixture was mixed with the Daymax mixer at 1200 RPM for 1 hour at 85° C., and then allowed to settle for 24 hours. The settled second mixture was filtered with a 1 micron filter to provide a lubricant composition.

Example 3

30 milliliters of the lubricant composition of Example 1 was combined with 1 liter of 10W-40 motor oil (Mobil 1) to provide a lubricating oil composition.

Examples 4 to 8 and Comparative Example 1

Four-Ball Wear

Lubricating oil compositions were prepared using the components and amounts provided in Table 1, wherein all amounts in Table 1 are in weight percent, based on the total weight of the lubricating oil composition. Example is abbreviated "Ex", and Comparative Example is abbreviated "CEx."

TABLE 1

| Component | Ex 4 | Ex 5 | Ex 6 | Ex 7 | Ex 8 | CEx 1 |
|---|---|---|---|---|---|---|
| 8 nm $WS_2$ | 5 | — | — | — | — | — |
| 2 μm $WS_2$ | — | 3 | 1 | — | — | — |
| Organo Tungsten agent | 5 | 5 | 5 | 5 | 5 | — |
| Boron Oxide | 3 | — | 3 | 3 | 3 | — |
| Diamond | 1 | 1 | — | 3 | — | — |
| 10W-40 Oil | 86 | 91 | 91 | 89 | 92 | 100 |
| Wear scar, mm | 0.39 | 0.37 | 0.34 | 0.52 | 0.34 | 0.49 |
| Coefficient of Friction | 0.017 | 0.07 | 0.075 | 0.071 | 0.75 | 0.089 |

In Table 1:

the 8 nm $WS_2$ is nested fullerene type 8-10 nm tungsten disulfide from Shanghai Zdan International Co. Ltd., Shanghai City, China;

the 2 μm $WS_2$ is nested fullerene type 2 μm tungsten disulfide from Shanghai Zdan International Co. Ltd., Shanghai City, China;

the organo tungsten agent is VANLUBE W-324 (Vanlube, Norwalk, Conn.);

the boron oxide is nanoparticle boron oxide, (No. 1220, GFS Chemicals, Inc. Powell, Ohio); and the diamond is nanoparticle diamond, (Nano-diamond 4-15 nm, Henan Huier Nano Technology Co., Ltd., Zhengzhou City, China).

To prepare the compositions of Examples 4-8, the tungsten disulfide (if present), organo tungsten agent, boron oxide (if present), and diamond (if present) were mixed with the Daymax Disperser Lab Unit equipped with the 7" diameter Daymax dispersion blade at 1200 RPM for 1 hour at 85° C. to form a first mixture, and then settled for 24 hours. The settled first mixture was then added to 10W-40 motor oil (Mobil 1) and mixed to provide a lubricating oil composition.

Comparative Example 1 is the 10W-40 motor oil (Mobil 1) and was not further treated.

The compositions of Examples 4-8 and Comparative Example 1 were evaluated by Four Ball Wear testing according to ASTM D-4172, using a 40 kilogram (kg) load at 1200 RPM for 1 hour at 75° C. The average diameter of the wear scar and the coefficient of friction were determined and are provided in FIGS. 1-6 and in Table 1.

As shown in Table 1, the coefficient of friction provided by the composition of Example 4 was surprisingly less than that of Examples 5-8, which included the 2 μm $WS_2$ instead of the 8 nm $WS_2$. Specifically, the coefficient of friction of Example 4 was 0.017, which is an 80% reduction as compared to the 10W-40 oil of Comparative Example 1, and a 77% to 75% percent reduction as compared to the compositions of Examples 5 to 8. Further, the size of the wear scar of Example 4 (0.37 millimeters, mm) was similar to that of Examples 5, 6, and 8, and smaller than that of Example 7 or Comparative Example 1, showing that the composition of Example 4 provides improved coefficient of friction while providing improved or similar wear when compared to the compositions of Examples 5-8 and Comparative Example 1.

Figure 6:
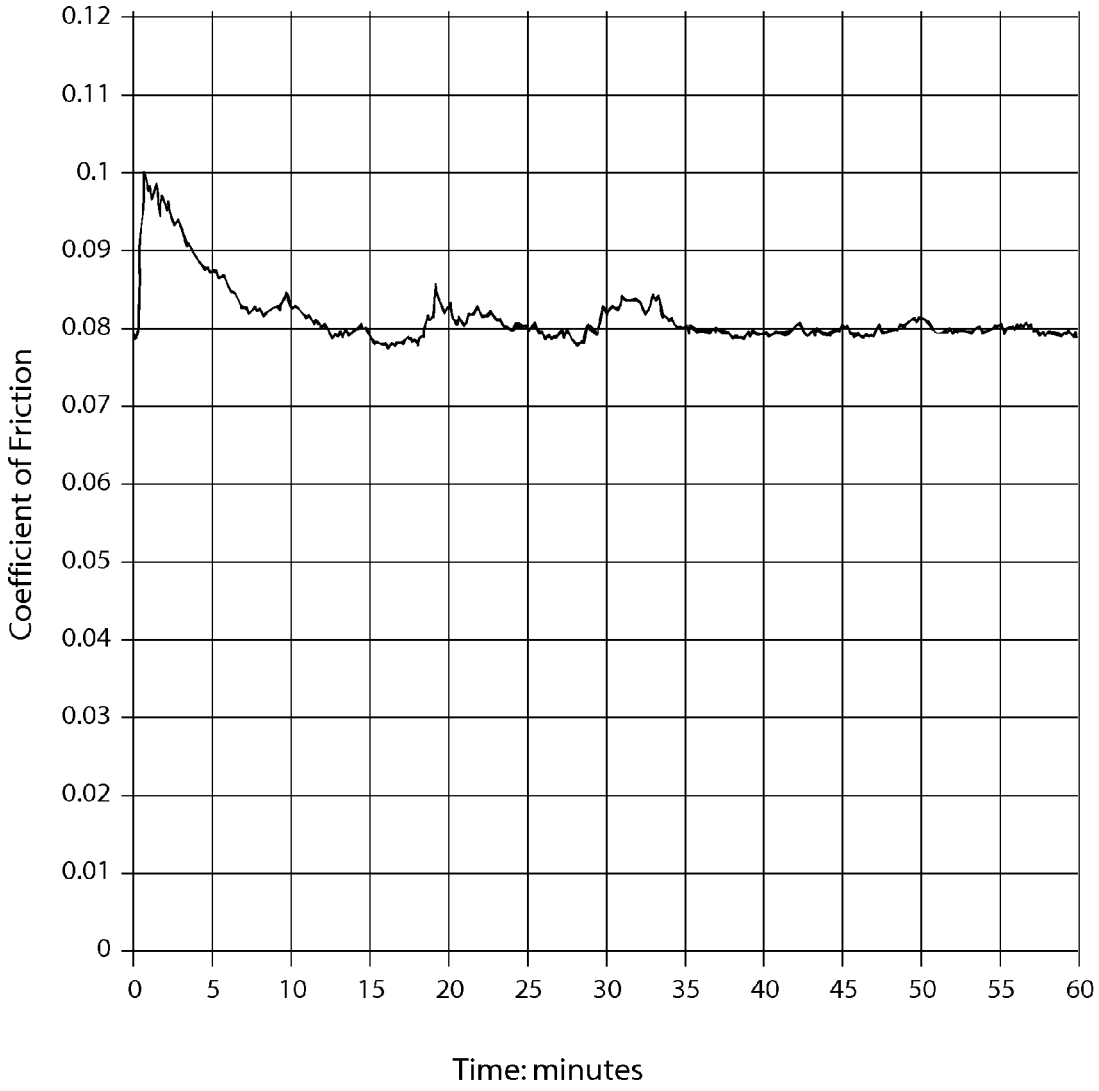
FIG. 6 is a graph of coefficient of friction versus time and shows the results of Comparative Example 1.

As shown in FIGS. 2-6, the coefficient of friction increased in Examples 5 to 8. In Comparative Example 1, as shown in FIG. 6, the coefficient of friction increased to 0.1 during the first 2 minutes of the test, and then decreased 0.8. Surprisingly, the coefficient of friction of Example 1, as shown in FIG. 1, decreased during the first 15 minutes of the test, and the decrease was most significant between the $10^{th}$ and the $15^{th}$ minute, where the coefficient of friction decreased from 0.03 to 0.016. While not wanting to be bound by theory, it is believed that the decrease in the coefficient of friction observed during the first 15 minutes of the test occurs as the tungsten disulfide, the boron oxide, and the diamond particles polish the moving surfaces and form a coating thereon. The rate of polishing and coating formation is understood to be temperature dependent. Thus as the temperature of the lubricant composition increases during the test the rate of coating formation increases, resulting in the surprising reduction in the coefficient of friction illustrated in FIG. 1.

Examples 9-13 and Comparative Examples 2-7

Lubricating compositions were prepared using the components and amounts provided in Table 2, wherein all amounts in Table 2 are in weight percent, based on the total weight of the lubricating composition. In each of Examples 9-13 and Comparative Examples 2-7, the tungsten disulfide ("IF $WS_2$," Inorganic Fullerene $WS_2$ 5-50 nm, AP Nano, Yavne, Israel), the diamond (3-4 nm non-detonation nanodiamond, product 0510HZ, SkySpring Nanomaterials, Houston, Tex.), the boron oxide (Product 1520DX, SkySpring Nanomaterials, Houston, Tex., "BO"), the organo tungsten agent (VANLUBE W-324, R.T. Vanderbilt Co., Inc., Norwalk, Conn., "OTA"), and the PAO4 (Product BD2003, DRD Additives, Belvidere, Ill.), (each if present) were blended with an immersion blender (Waring WSB70, 750 W) at 4000 RPM to 8000 RPM for 15 minutes, followed by high-shear mixing with an ultrasonic mixer (Sonolator, Sonic Corporation, Stratford, Conn.) for 60 minutes at 100° C. to provide a lubricating composition.

The coefficient of friction ("COF") of each composition was determined by 4-ball wear in accordance with ASTM D4172B under a load of 40 kilograms for 60 minutes. The COF results are reported in Table 2.

TABLE 2

| Component | Ex. 9 | Ex. 10 | Ex. 11 | Ex. 12 | Ex. 13 | CEx. 2 | CEx. 3 | CEx. 4 | CEx. 5 | CEx. 6 | CEx. 7 |
|---|---|---|---|---|---|---|---|---|---|---|---|
| IF $WS_2$ | 0.08 | 0.08 | 0.08 | 0.08 | 0.08 | 0.08 | — | — | — | — | — |
| Diamond | 0.08 | 0.08 | — | 0.08 | — | — | 0.08 | — | — | — | 0.08 |
| BO | 0.39 | 0.39 | 0.39 | — | 0.39 | — | — | 0.39 | — | — | 0.39 |
| OTA | 2.28 | — | 2.28 | 2.28 | — | — | — | — | 2.28 | — | 2.28 |
| PAO4 | 97.17 | 99.45 | 97.25 | 97.56 | 99.53 | 99.92 | 99.92 | 99.61 | 97.72 | 100.00 | 97.25 |
| COF | 0.020 | 0.048 | 0.030 | 0.033 | 0.038 | 0.043 | 0.046 | 0.038 | 0.040 | 0.061 | 0.038 |

Examples 14-18 and Comparative Examples 8-10

Lubricating compositions were prepared using the components and amounts provided in Table 3, wherein all amounts in Table 3 are in weight percent, based on the total weight of the lubricating composition. In each of Examples 9-13 and Comparative Examples 2-7, the tungsten disulfide ("IF $WS_2$" Inorganic Fullerene $WS_2$ 5-50 nm, AP Nano, Yavne, Israel), the potassium borate (SkySpring nanomaterials 5-50 nm, the antimony dialkyldithiocarbamate composition (Octopol AD, Tiarco Chemical), the borate ester composition ("V289", VANLUBE 289, R.T. Vanderbilt Co., Inc., Norwalk, Conn.), and the PAO4 (Product BD2003, DRD Additives, Belvidere, Ill.), (each if present) were blended with an immersion blender (Waring WSB70, 750 W) at 4000 RPM to 8000 RPM for 15 minutes, followed by high-shear mixing with an ultrasonic mixer (Sonolator, Sonic Corporation, Stratford, Conn.) for 60 minutes at 100° C. to provide a lubricating composition.

The coefficient of friction ("COF") of each composition was determined by 4-ball wear in accordance with ASTM D4172B under a load of 40 kilograms for 60 minutes. The COF results are reported in Table 2.

TABLE 3

| Component | Ex. 14 | Ex. 15 | Ex. 16 | Ex. 17 | Ex. 18 | CEx.8 | CEx.9 | CEx.10 |
|---|---|---|---|---|---|---|---|---|
| IF WS2 | 0.06 | 0.10 | 0.08 | 0.06 | — | — | — | — |
| Potassium Borate | 0.31 | 0.50 | 0.38 | — | 0.31 | 0.50 | — | — |
| Octopol AD | 18.52 | — | 22.73 | 18.58 | 18.53 | — | 22.84 | — |
| V289 | 18.52 | — | — | 18.58 | 18.53 | — | — | 22.84 |
| PAO4 | 62.58 | 99.40 | 76.81 | 62.78 | 62.62 | 99.50 | 77.16 | 77.16 |
| COF | 0.011 | 0.034 | 0.033 | 0.038 | 0.028 | 0.044 | 0.038 | 0.03 |

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the lubricant composition in its intended use, may not be susceptible of easy description. Nevertheless, all such modifications and reaction products are included within the scope of the present disclosure; and the present disclosure encompasses a composition prepared by admixing the components disclosed above.

This invention may be embodied in many different forms, and should not be construed as limited to the embodiments set forth herein. Rather, these embodiments are provided so that this disclosure will be thorough and complete, and will fully convey the scope of the invention to those skilled in the art.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an" and "the" are intended to include the plural forms as well, unless the context clearly indicates otherwise. "Or" includes "and/or." It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Unless otherwise specified, particle sizes are determined using dynamic light scattering.

"Alkyl" means a straight or branched chain, saturated, monovalent hydrocarbon group (e.g., methyl or hexyl).

"Alkenyl" means a straight or branched chain, monovalent hydrocarbon group having at least one carbon-carbon double bond (e.g., ethenyl (—HC═$CH_2$)).

"Alkynyl" means a straight or branched chain, monovalent hydrocarbon group having at least one carbon-carbon triple bond (e.g., ethynyl).

"Aryl" means a monovalent group formed by the removal of one hydrogen atom from one or more rings of an arene (e.g., phenyl or napthyl).

"Arylalkyl" means a substituted or unsubstituted aryl group covalently linked to an alkyl group that is linked to a compound (e.g., a benzyl is a C7 arylalkyl group).

"Alkoxy" means an alkyl group that is linked via an oxygen (i.e., alkyl-O—), for example methoxy, ethoxy, and sec-butyloxy groups.

"Cycloalkyl" means a monovalent group having one or more saturated rings in which all ring members are carbon (e.g., cyclopentyl and cyclohexyl).

"Cycloalkenyl" means a monovalent group having one or more rings and one or more carbon-carbon double bond in the ring, wherein all ring members are carbon (e.g., cyclopentyl and cyclohexyl).

The prefix "hetero" means that the compound or group includes at least one ring that is a heteroatom (e.g., 1, 2, or 3 heteroatom(s)), wherein the heteroatom(s) is each independently N, O, S, Si, or P.

A "hydrocarbyl group" as used herein means a group having an appropriate valence in view of the number of substitutions shown in the structure. Hydrocarbyl groups contain at least carbon and hydrogen, and can optionally contain 1 or more (e.g., 1-8) heteroatoms selected from N, O, S, Si, P, or a combination thereof. Hydrocarbyl groups can be unsubstituted or substituted with one or more substituent groups up to the valence allowed by the hydrocarbyl group independently selected from a C1-30 alkyl, C2-30 alkenyl, C2-30 alkynyl, C6-30 aryl, C7-30 arylalkyl, C1-12 alkoxy, C1-30 heteroalkyl, C3-30 heteroarylalkyl, C3-30 cycloalkyl, C3-15 cycloalkenyl, C6-30 cycloalkynyl, C2-30 heterocycloalkyl, halogen (F, Cl, Br, or I), hydroxy, nitro, cyano, amino, azido, amidino, hydrazino, hydrazono, carbonyl, carbamyl, thiol, carboxy (C1-6alkyl) ester, carboxylic acid, carboxylic acid salt, sulfonic acid or a salt thereof, and phosphoric acid or a salt thereof.

As used herein, the term "fatty acid" means a carboxylic acid having the formula RCOOH. R represents an aliphatic group, preferably an alkyl group. R can comprise 4 or more carbon atoms. The fatty acid can be a C4 to C30 fatty acid, specifically a C6 to C20 fatty acid. In an embodiment, the fatty acid comprises 4 to 22 carbon atoms. Fatty acids can be saturated, monounsaturated, or polyunsaturated. In addition, fatty acids can comprise a straight or branched chain. The branched chains may have one or more points of branching. In addition, the branched chains may include cyclic branches.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A lubricant composition comprising:

tungsten disulfide having a particle size of 4 to 160 nanometers;

an alkali metal borate;

a borate ester; and a base oil.

2. The lubricant composition of claim 1, wherein the tungsten disulfide has an average particle size of 10 to 1000 nm.

3. The lubricant composition of claim 1, wherein the tungsten disulfide is inorganic fullerene tungsten disulfide.

4. The lubricant composition of claim 1, wherein the tungsten disulfide is contained in an amount of 0.01 to 3 weight percent, based on a total weight of the lubricant composition.

5. The lubricant composition of claim 1, wherein the alkali metal borate comprises sodium borate, potassium borate, or a combination thereof.

6. The lubricant composition of claim 5, wherein the alkali metal borate is potassium borate.

7. The lubricant composition of claim 6, wherein the potassium borate is $KBO_2$, $KB_5O_8.4H_2O$, $KBO_2.½H_2O$, $K_2B_4O_7.4H_2O$, $K_2B_4O_7.8H_2O$, $KB_3O_5.3H_2O$, or a combination thereof.

8. The lubricant composition of claim 5, wherein the alkali metal borate is contained in an amount of 0.01 to 3 weight percent, based on a total weight of the lubricant composition.

9. The lubricant composition of claim 1, wherein the borate ester is a reaction product of a fatty oil, a dialkanolamine, and a boric acid.

10. The lubricant composition of claim 1, wherein the borate ester is according to Formula 1:

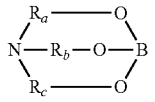

(1)

wherein in Formula 1, Ra, Rb, and Rc are each independently a substituted or unsubstituted C1 to C20 alkylene group, a substituted or unsubstituted C6 to C26 cycloalkylene group, a substituted or unsubstituted C6 to C26 arylene group, a substituted or unsubstituted C6 to C26 alkylarylene group, or a substituted or unsubstituted C6 to C26 arylalkylene group.

11. The lubricant composition of claim 10, wherein the borate ester is triisopropanolamine borate.

12. The lubricant composition of claim 1, wherein the borate ester is contained in an amount of 0.0001 to 20 weight percent, based on a total weight of the lubricant composition.

13. The lubricant composition of claim 1, wherein the base oil comprises a polyalphaolefin.

14. The lubricant composition of claim 1, wherein the tungsten disulfide is inorganic fullerene tungsten disulfide, the alkali metal borate is potassium borate, the borate ester is a reaction product of a fatty oil, a dialkanolamine, and a boric acid, and the base oil is a polyalphaolefin.

15. An applicator having the lubricant composition of claim 1 disposed on the applicator.

16. The applicator of claim 15, wherein the applicator is effective to clean a bore of a firearm.

17. firearm cleaning system comprising:

a container;

an applicator disposed in the container; and a lubricant composition disposed on the applicator, wherein the lubricant composition comprises tungsten disulfide comprising tungsten disulfide particles having a diameter of 4 to 160 nanometers;

an alkali metal borate;

a borate ester; and a base oil.

18. The firearm cleaning system of claim 17, wherein the container is a tear-open pouch.

19. The firearm cleaning system of claim 18, wherein the tear-open pouch comprises a thermoplastic film.

20. A method of manufacturing a lubricant composition, the method comprising:

contacting tungsten disulfide having a particle size of 4 to 160 nanometers, an alkali metal borate, a borate ester, and a base oil under conditions effective to disperse the tungsten disulfide, the alkali metal borate, and the borate ester in the base oil to manufacture the lubricant composition.

21. The lubricant composition of claim 1, wherein a content of the base oil is 5 to 99.9 weight percent, based on a total weight of the lubricant composition.

* * * * *